US010207726B2

(12) United States Patent
Bartek et al.

(10) Patent No.: US 10,207,726 B2
(45) Date of Patent: Feb. 19, 2019

(54) ENHANCED RAIL WORKER PROTECTION WARNING SYSTEM (PWS)

(71) Applicant: HARSCO TECHNOLOGIES LLC, Fairmont, MN (US)

(72) Inventors: Peter Michael Bartek, Ledgewood, NJ (US); Michael Stephen Davis, Westminster, MD (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 0 days.

(21) Appl. No.: 15/722,673

(22) Filed: Oct. 2, 2017

(65) Prior Publication Data

US 2018/0093687 A1 Apr. 5, 2018

Related U.S. Application Data

(60) Provisional application No. 62/402,039, filed on Sep. 30, 2016.

(51) Int. Cl.

| | |
|---|---|
| ***B61L 23/06*** | (2006.01) |
| ***G08B 21/02*** | (2006.01) |
| ***G08B 6/00*** | (2006.01) |
| ***G08B 5/36*** | (2006.01) |
| ***G08B 3/10*** | (2006.01) |

(52) U.S. Cl.
CPC ..... *B61L 23/06* (2013.01); *G08B 3/10* (2013.01); *G08B 5/36* (2013.01); *G08B 6/00* (2013.01); *G08B 21/02* (2013.01)

(58) Field of Classification Search
None
See application file for complete search history.

(56) References Cited

U.S. PATENT DOCUMENTS

2006/0261219 A1* 11/2006 Sharkey ..... B61L 29/30 246/473.1
2013/0217332 A1* 8/2013 Altman ..... H04H 60/90 455/41.2

OTHER PUBLICATIONS

Philadephia CBS Local News Article and Video, entitled "SEPTA Track Workers Get New Safety Protection That Could Save Lives", dated Apr. 28, 2016 (Apr. 28, 2016), attributed to Walt Hunter;<<http://philadelphia.cbslocal.com/2016/04/28/septa-track-workers-get-new-safety-protection-that-could-save-lives/>>.

* cited by examiner

*Primary Examiner* — Leon Viet Q Nguyen
(74) *Attorney, Agent, or Firm* — Baker & McKenzie LLP

(57) ABSTRACT

A rail worker protection system having a first device configured to generate and send an identification code, a second device configured to transmit a request to the first device and to transmit a signal to one or more remote devices, and the remote device able to issue alarms to rail workers upon reception of the signal from the second device.

12 Claims, 19 Drawing Sheets

ENHANCED RAIL WORKER PROTECTION WARNING SYSTEM (PWS)

CROSS-REFERENCE TO RELATED APPLICATION

This application claims priority to U.S. Provisional Patent Application No. 62/402,039 filed on Sep. 30, 2016, the disclosure of which is hereby incorporated by reference in entirety.

BACKGROUND

At a rail maintenance and construction job site, rail workers in close proximity to the railroad tracks need to be made aware of emergency situations as quickly and effectively as possible. In previous and well known approaches, a designated person acts as a lookout for incoming trains. When the person sees an approaching train on the tracks, the person may warn others by verbal communication (yelling or talking), or by visual communication (raising a flag or sign).

The primary disadvantage of this method is that rail work is frequently loud, where digging, hammering, tamping, and other loud-noise producing acts will frequently drown out any verbal communication from the lookout. Also, due to the length and bends of certain tracks, the lookout's view may be obstructed so that the lookout cannot know for sure if all of the rail workers at a job site had received the verbal or visual warnings. Track supervisors and track workers do have radio communications but those communications do not provide warnings and in many cases ambient noise in the work areas causes miscommunications. Therefore, there is a need for an improved rail worker protection and warning system at rail maintenance job sites and during track inspection using a failsafe way to communicate with confirmation from the dispatcher to the roadway worker in charge, lone worker or track inspector to the track workers that they are safely off the tracks before live trains can be allowed through where those personnel are operating on the tracks.

BRIEF SUMMARY

The present disclosure provides an improved rail worker warning system over those of the prior art. Specifically, the system gives a dispatcher, roadway worker in charge, multiple track workers and lone workers a method to confirm and acknowledge that rail workers or on-track vehicles and work equipment are safely off the tracks. The system can also send out emergency notifications to any rail worker or on-track equipment to evacuate the tracks.

The system includes a roadway worker in charge (RWIC) device configured to transmit a request to a dispatcher device to take a portion of rail tracks out of service (TOOS), to prompt a RWIC to input required job site information needed for TOOS approval, to transmit the required job site information to the dispatcher device, and to display a notification that the request is approved when the dispatcher has determined that the required job site information contained an accurate identification code, a location coordinate, and that all rail workers have scanned in to the RWIC device.

The system further includes one or more emergency personnel units having one or more alarm components and an acknowledgement interface, whereby the alarm components may issue an alarm when the emergency personnel unit receives a scan-in signal, emergency signal, or exit track signal from the RWIC device. The emergency personnel unit is also configured to transmit a corresponding confirmation signal back to the RWIC device, where the confirmation signal may correspond to the type of signal it had received from the RWIC device.

The system further includes the RWIC device configured to transmit a request to a dispatcher device to return the portion of rail tracks back to service, to prompt the RWIC to input required back to service information needed for dispatcher's approval, to transmit the required back to service information to the dispatcher device, and to display a notification that the request is approved.

BRIEF DESCRIPTION OF THE DRAWINGS

Reference is now made to the following descriptions taken in conjunction with the accompanying drawings.

DETAILED DESCRIPTION

Various embodiments of an Enhanced Rail Worker Protection Warning System (PWS) for rail applications are described. It is to be understood, however, that the following explanation is merely exemplary in describing the devices and methods of the present disclosure. Accordingly, several modifications, changes and substitutions are contemplated.

Figure 1:
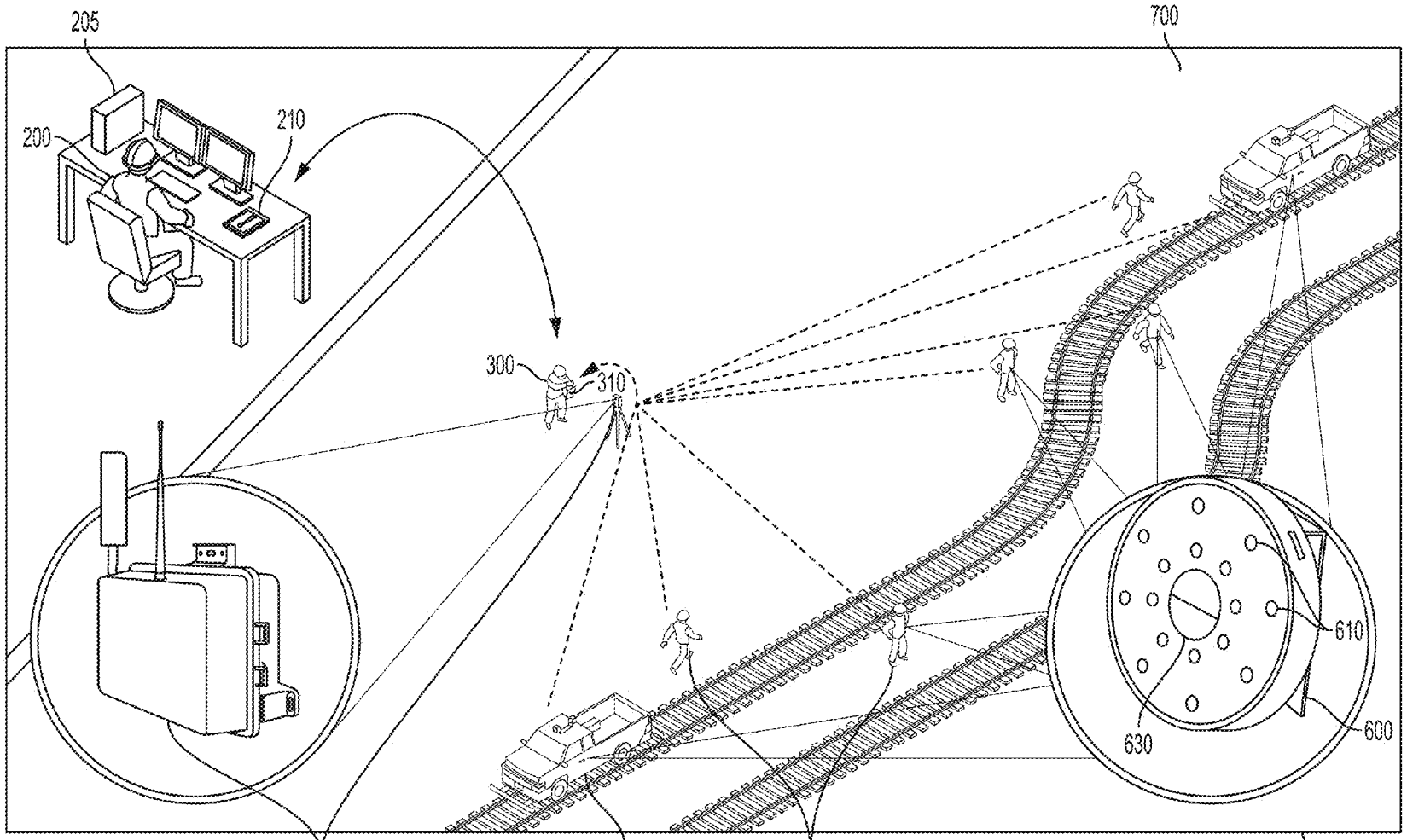
FIG. 1 illustrates an Enhanced Rail Worker Protection Warning System (PWS) according to one embodiment of the present disclosure as implemented at a job site.

Referring to FIG. 1, an embodiment of a PWS 100 that coordinates communication between a dispatcher 200, a Rail Worker in Charge (RWIC) 300 of a job site 700, and a number of rail workers 500 of the job site 700 is disclosed. The PWS 100 allows fast and reliable alarms to be sent to rail workers 500 of the job site to improve worker safety during any type of track work.

The dispatcher 200 may be an off-site manager who is stationed away from job sites. In an embodiment of the PWS 100, the dispatcher 200 may utilize a dispatcher computer system 205 and a dispatcher device 210. Both the dispatcher computer system 205 and the dispatcher device 210 may be any type of computing device, such as a PC, laptop, tablet, smartphone, etc., where the dispatcher computer system 205 and the dispatcher device 210 may communicate with each other and other computing devices via a first communication medium, such as internet, local network, cellular, blue tooth, Wi-Fi, radio, or other communication mediums. In addition, both the dispatcher device 210 and the dispatcher computer system 205 may include computer-readable mediums having instructions to execute and carry out particular functions and steps of an embodiment of the present disclosure, and may be operable to receive input from the dispatcher 200 through keyboard, mouse, touch screen, voice recoding, image recognition, or other devices for input reception. In an embodiment, the dispatcher computer system 205 is a PC or desktop computing machine and the dispatcher device 210 is a tablet or any other smart mobile device.

Figure 4:
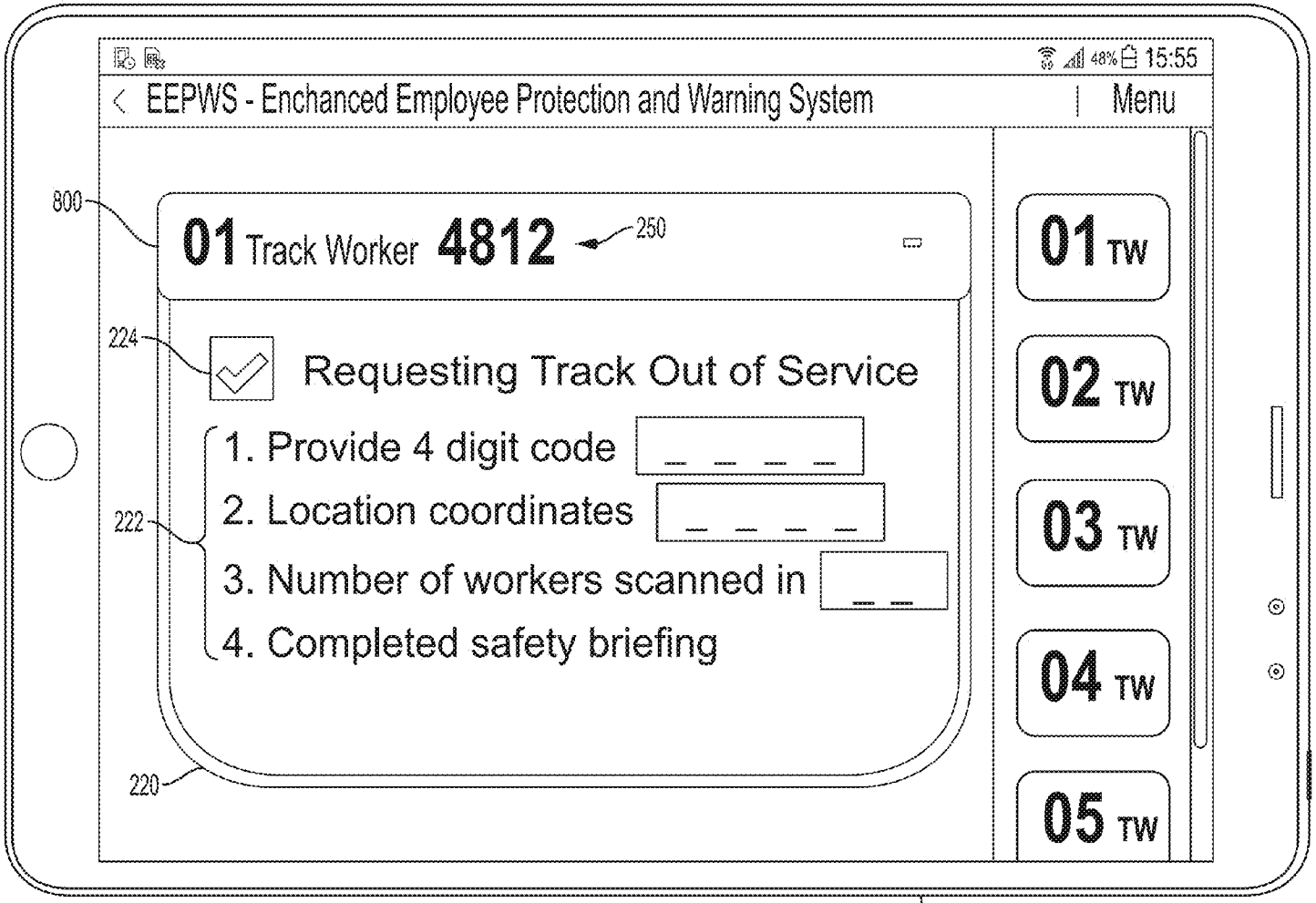
FIG. 4 illustrates the dispatcher device displaying a TOOS menu.

The dispatcher device's computer-readable medium may include instructions that, when executed by at least one or more processors, cause the dispatcher device 210 to generate a special random numerical or alphabetical identification code 250 (FIG. 4). This identification code 250 may be automatically generated by the dispatcher device 210, and acts as a security mechanism where only authorized devices may request and otherwise communicate with the dispatcher device 210 and dispatcher computer system 205. In an embodiment, the identification code 250 is automatically generated by the dispatcher computer system 205, and then automatically transmitted to the dispatcher device 210. In an embodiment, the identification code 250 has a minimum of four digits. In another embodiment, the code 250 has between three to ten digits. Each digit may be a number, an alphabet, or a symbol. In an embodiment, the identification code 250 is a random numerical digital code embodying instructions which takes the rail track out of service or brings the track back into service. The code 250 may also embody the dispatcher name, RWIC name, worker name, worker identification, work limit, location coordinates, GPS coordinates, rail road markers, or other information. Details regarding the usage of the identification code 250 will be described later in this disclosure.

The RWIC 300 may be an on-site worker who is dispatched to a job site 700 to oversee track work at that job site 700. The RWIC 300 may operate an RWIC device 310, where the RWIC device 310 may be a tablet, smart phone, PC, Mac, laptop, or any other computing device. The RWIC device 310 may be able to communicate with the dispatcher device 210, the dispatcher computer system 205, and/or one or more emergency personnel units (EPU) 600 via a second communication medium, such as internet, network, cellular, blue tooth, Wi-Fi, radio, or other communication mediums. In this way, the RWIC 300 may communicate with the dispatcher 200 via the RWIC device 310 and the dispatcher device 210. In an embodiment of the disclosure, the identification code 250 is sent from the dispatcher device 210 to the RWIC device 310. In an embodiment of the disclosure, the dispatcher 200 may communicate with multiple RWICs located at multiple job sites, where the dispatcher computer system 205 or the dispatcher device 210 may generate a different identification code for each of the RWIC devices. Alternatively, the same identification code may be issued to all RWIC devices that may communicate with the dispatcher device 210. The goal of using the identification code remains the same—to verify that only authorized RWIC devices 310 having the correct identification code 250 may communicate with the dispatcher device 210.

Each rail worker 500 of the job site 700 is assigned and given one of the EPUs 600 to keep on their person as long as the rail worker 500 is at or near the job site 700. Each EPU 600 may include at least a visual alarm component 610, an audio alarm component (not shown), and an acknowledgment interface 630. The visual alarm component 610 may be a number of lights (LED etc.) or a display screen that may flash at intervals and/or having different colors; the audio alarm component may be a speaker or any other audio producing device; and the acknowledgement interface 630 may be a button, a switch, a touch screen, or any other appropriate interface with which the corresponding rail worker 500 may interact. The EPU 600 may also vibrate to provide a physical alarm to the rail worker. The visual, audio, and physical alarms aim to attract the attention of the rail worker 500 in possession of the EPU 600, and the rail worker 500 may acknowledge receipt of the alarms by interacting with the acknowledgement interface 630. For example, when the rail worker 500 sees, hears, and/or feels the alarms generated by the assigned EPU 600, the rail worker 500 may interact with the acknowledgement interface 603 (e.g. press on the interface 603 if it is a button, flip the interface 603 if it is a switch, or tap/swipe the interface 603 if it is a touchscreen) to confirm receipt of the alarm. In a particular embodiment, the EPU 600 may also be assigned to on-track vehicles 510 to alert rail workers 500 around the area that the vehicles 510 may pose a hazard on the job site 700. In an embodiment, the EPU 600 may be a portable/wearable smart device having a computer-readable medium embodying instructions which, when executed by an EPU processor, causes the EPU 600 to alert the rail worker. For example, the EPU 600 may be the rail worker's smart phone having the correct application or software installed thereon. The smart phone's visual alarm component and acknowledgement interface may be the same or different portions of the smart phone's touch screen. The EPU 600 may also be any standalone device manufactured to include some or all components of the EPU disclosed in the discussion above. The EPU 600 may further include a radio, a battery, and a clip to be worn on clothing such as a safety vest or belt. In an embodiment, the EPU radio may be a 900 MHz radio or a 2.4 GHz chirping radio. The EPU 600 may also include an on and off button.

In a job site where there are no obstructions to normal communication, the RWIC device 310 may communicate directly with the EPUs 600 via blue tooth, radio, cellular, Wi-Fi, or other communicates medium. However, in job sites having tunnels and dark territories where standard communications links are not available, a main portable wayside device (MPWD) also known as a master unit 400 may be used as an intermediary/relay/communications extender between the RWIC device 310 and the EPUs 600. The master unit 400 may be placed near a particular track location at the job site 700 managed by the RWIC 300. The RWIC device 310 may communicate with the master unit 400 through standard communication means, and then the master unit 400 can communicate with EPUs 600 using radio, cellular, Wi-Fi, or other reliable communications. In an embodiment, the master unit 400 may communicate with the EPU 600 using a spread spectrum and chirping spread spectrum of a specific frequency. In an embodiment, the master unit 400 automatically receives the identification code 250 from the RWIC's computer-readable medium. In an embodiment, the master unit 400 may communicate with the EPUs 600 using 900 MHz spread spectrum and 2.4 GHz chirping spread spectrum. In an embodiment, the master unit 400 can communicate with the EPUs 600 up to a 5 mile radius away from the master unit 400. The master unit 400 may also be used at a job site free of obstructions to normal communication.

As disclosed above, the PWS 100 may be used to provide reliable real-time communication between the dispatcher 200, the RWIC 300, and the rail workers 500 at different job sites. In an embodiment, the PWS 100 allows the RWIC 300 to request a Track Out Of Service (TOOS) status for a section of train tracks at the RWIC's corresponding job site, to send an emergency alert to all EPUs 600 at the RWIC's corresponding job site when TOOS status has been granted for that job site, and to contact the dispatcher 200 to return the track to service. These systems and methods of communication will be discussed below.

To ensure that the PWS 100 is a secure and reliable railway warning system, the PWS 100 must assign proper authorization criteria to each RWIC 300 of the different job sites. As discussed above, either the dispatcher computer system 205 or the dispatcher device 210 may generate the identification code 250. The code 250 may be one code that is used for all authorized RWICs, or a unique code 250 assigned to each of the individual RWICs. In the case where the dispatcher computer system 205 generates the identification code 250, the code 250 is then automatically transmitted to the dispatcher device 210. After the dispatcher device 210 either receives and stores the code 250 or generates the identification code 250, it is subsequently sent to all RWIC devices 310 communicatively linked to the dispatcher device 210. Each RWIC 300 will be able to view the identification code 250 on their respective RWIC device 310, and the RWICs 300 may use the identification code 250 whenever the RWIC 300 wants to communicate with the dispatcher device 210. In an embodiment, the RWIC 300 may use the corresponding RWIC device 310 to request the identification code 250 from the dispatcher device 210 at any time. Upon receiving RWIC's request for identification code, the dispatcher device 210 may send the identification code 250 to the requesting RWIC device 310. Alternatively, the dispatcher device 210 may request a new identification code 250 from the dispatcher system 205, store the new identification code 250 corresponding to the requesting RWIC 300, then send the new identification code 250 to the requesting RWIC device 310. As a result, prior to the RWIC 300 sending any track work related requests to the dispatcher 200, each RWIC 300 will have known the identification code 250, and the dispatcher device 210 would have stored the identification code corresponding to each RWIC 300 and RWIC devices 310.

The discussion above disclosed many components of embodiments of the PWS 100. An exemplary method of how the dispatcher 200 may receive and confirm a request from the RWIC 300 to take a section of rail tracks out of service will now be discussed.

Figure 2:
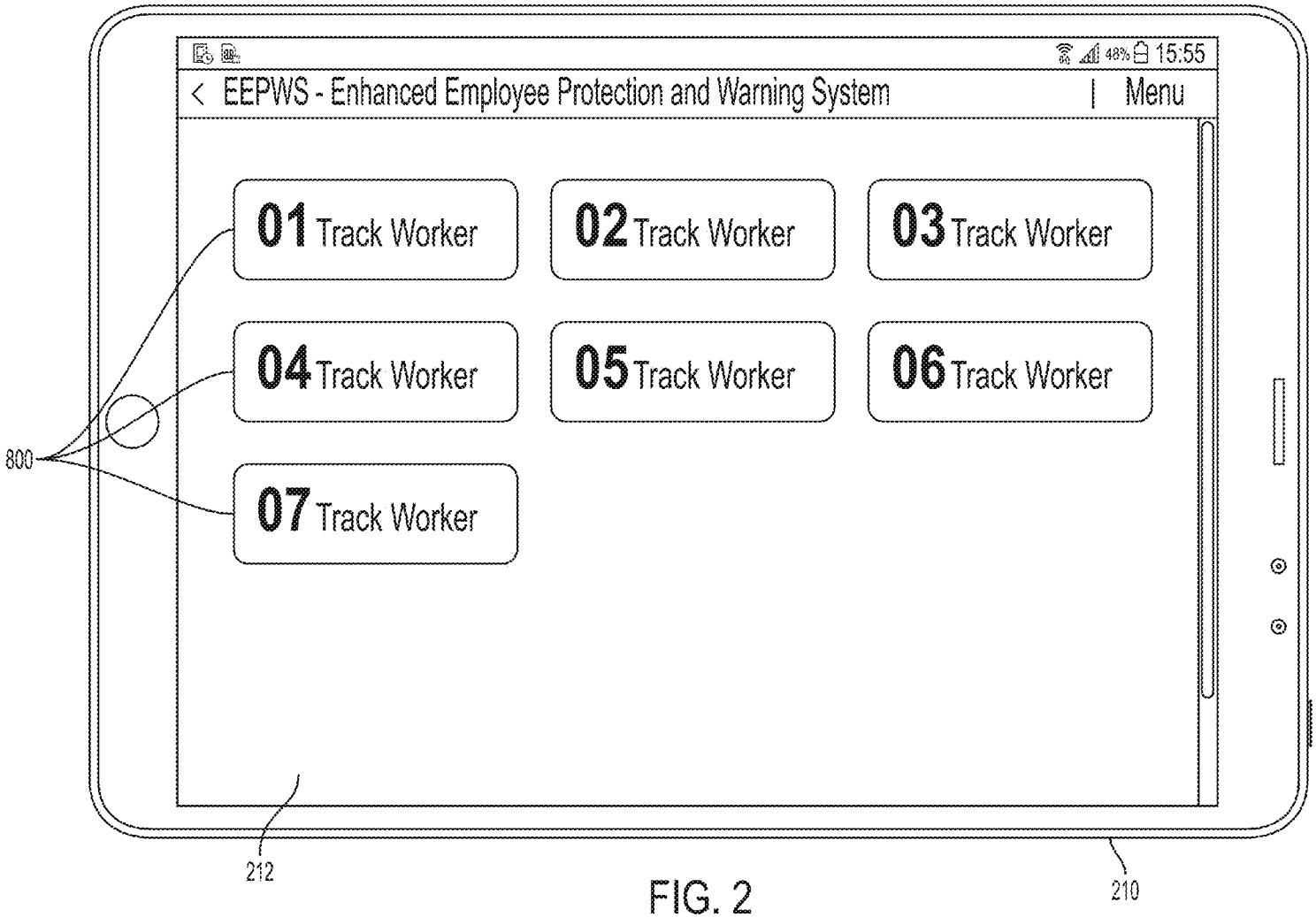
FIG. 2 illustrates a dispatcher device displaying a main PWS dispatcher interface according to one embodiment of the present disclosure.

FIG. 2 discloses the dispatcher device 210. In this embodiment, the dispatcher device 210 is a tablet. However, the dispatcher device 210 may be a PC, Mac computer, laptop, smart mobile device, or any other type of computer system capable of executing instructions to implement the system and methods of this disclosure. The dispatcher device 210 includes a screen 212, which may display a main PWS dispatcher interface shown here. In showing the main PWS dispatcher interface, the screen 212 displays a number of different RWIC IDs 800. Each of the displayed RWIC ID 800 corresponds to a different RWIC 300 at a different job site 700 so that the dispatcher 200 is able to interact with multiple RWICs using one dispatcher device 210. In an embodiment, the RWIC ID 800 may be used to indicate a track status at the job site corresponding to the RWIC ID 800. For example, an RWIC ID 800 of "01 Track Worker" may be disclosed in a different color or font to show that the track status at that job site is out of service.

Figure 3:
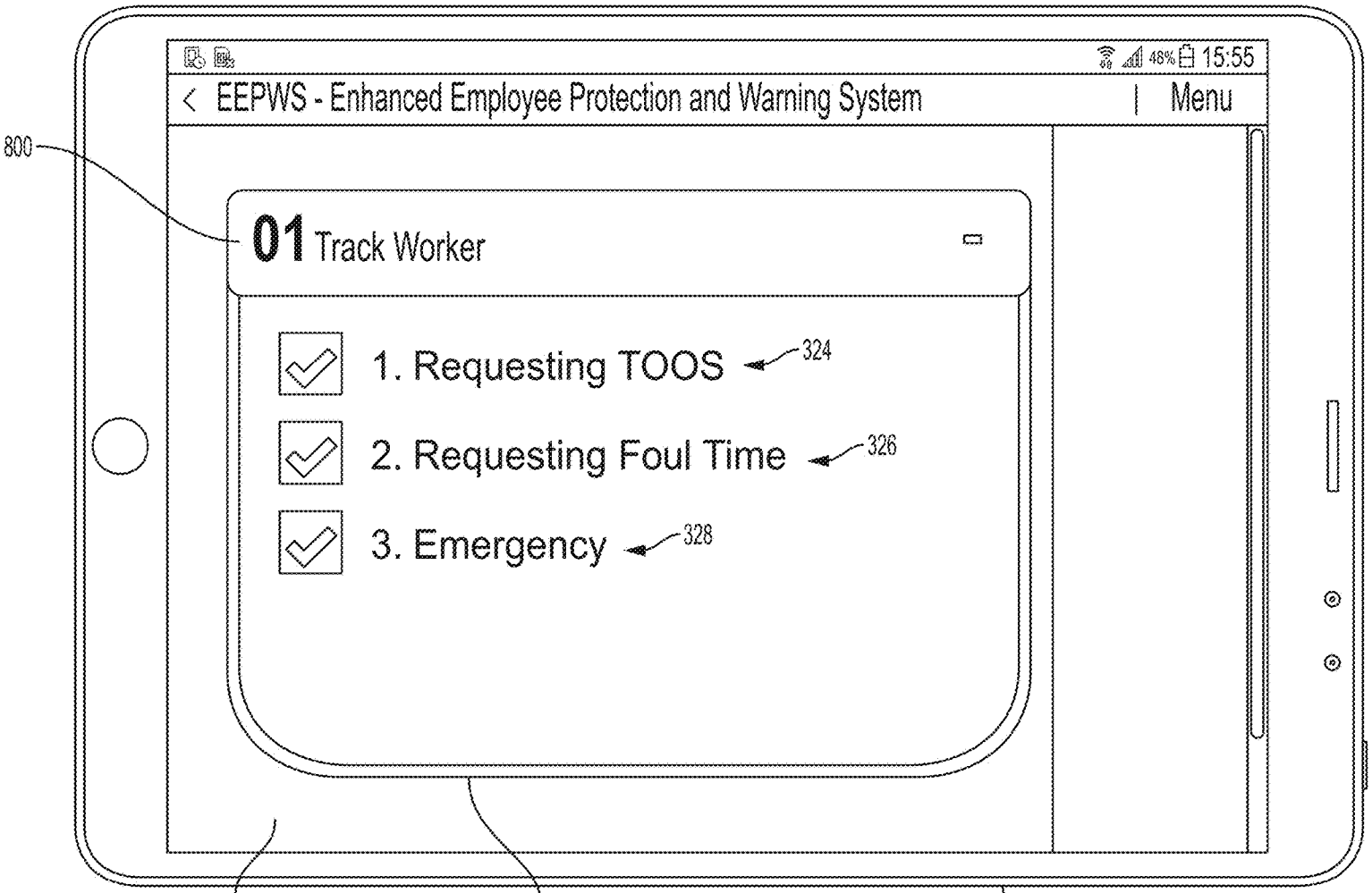
FIG. 3 illustrates a RWIC device displaying a TOOS request menu.

FIG. 3 discloses an embodiment of the RWIC device 310, where the RWIC device 310 is a tablet. However, the RWIC device 310 may also be a PC, Mac computer, laptop, smart mobile device, or any other type of computer system capable of executing instructions to implement the system and methods of this disclosure. The RWIC device 310 includes a screen 312 that displays the RWIC ID 800 of the RWIC 300 using the RWIC device 310. In this embodiment, the RWIC ID 800 is "01 Track Worker" as discussed above. For ease of discussion, the RWIC 300 of job site 700 as disclosed in FIG. 1 has RWIC ID of "01 Track Worker".

When RWIC 300 wants to send a request to the dispatcher 200, RWIC 300 may activate the RWIC device 310 by tapping on the RWIC ID 800 on the screen 312. In response, the RWIC device 310 displays a request menu 320, which lists options available to the RWIC 300. The request menu 320 may be a menu that is dropped down from the RWIC ID 800 displayed on screen 312. In an embodiment, the request menu 320 may include a "Request TOOS" option 324, a "Request Foul Time" option 326, and an "Emergency" option 328. When RWIC 300 taps on one of the options or a check box corresponding to the options, the RWIC device 310 will send a corresponding request to the dispatcher device 210.

In an embodiment, RWIC 300 would like to request the dispatcher 200 to set tracks of the corresponding job site 700 to be out of service so that trains will not pass through the job site 700 during track maintenance. As discussed above, the RWIC 300 may tap on the "Request TOOS" option 324 on the RWIC device 310, and the RWIC device 310 will send a TOOS request to the dispatcher device 210.

Referring to FIG. 4, the dispatcher device 210, upon receipt of the TOOS request, may display a TOOS menu 220 under the RWIC ID 800 corresponding to the requesting RWIC 300. In an embodiment, the TOOS menu 220 may be a drop down menu displayed under the RWIC ID 800 of the requesting RWIC 300. As seen in FIG. 4, the TOOS menu 220 displays a list of required TOOS information 222 that the requesting RWIC 300 must provide in order for the dispatcher 200 to approve the TOOS request. In an embodiment, the list of required TOOS information 222 includes providing the correct identification code by the RWIC 300, providing location coordinates of the rail tracks that RWIC 300 is requesting to be taken off line, providing the total number of rail workers 500 at the job site 700, and confirming that the RWIC 300 has completed a safety briefing with the rail workers at the job site 700. The dispatcher 200 may send a request for the required TOOS information by tapping on a check box 224 on the TOOS drop down menu.

Figure 5:
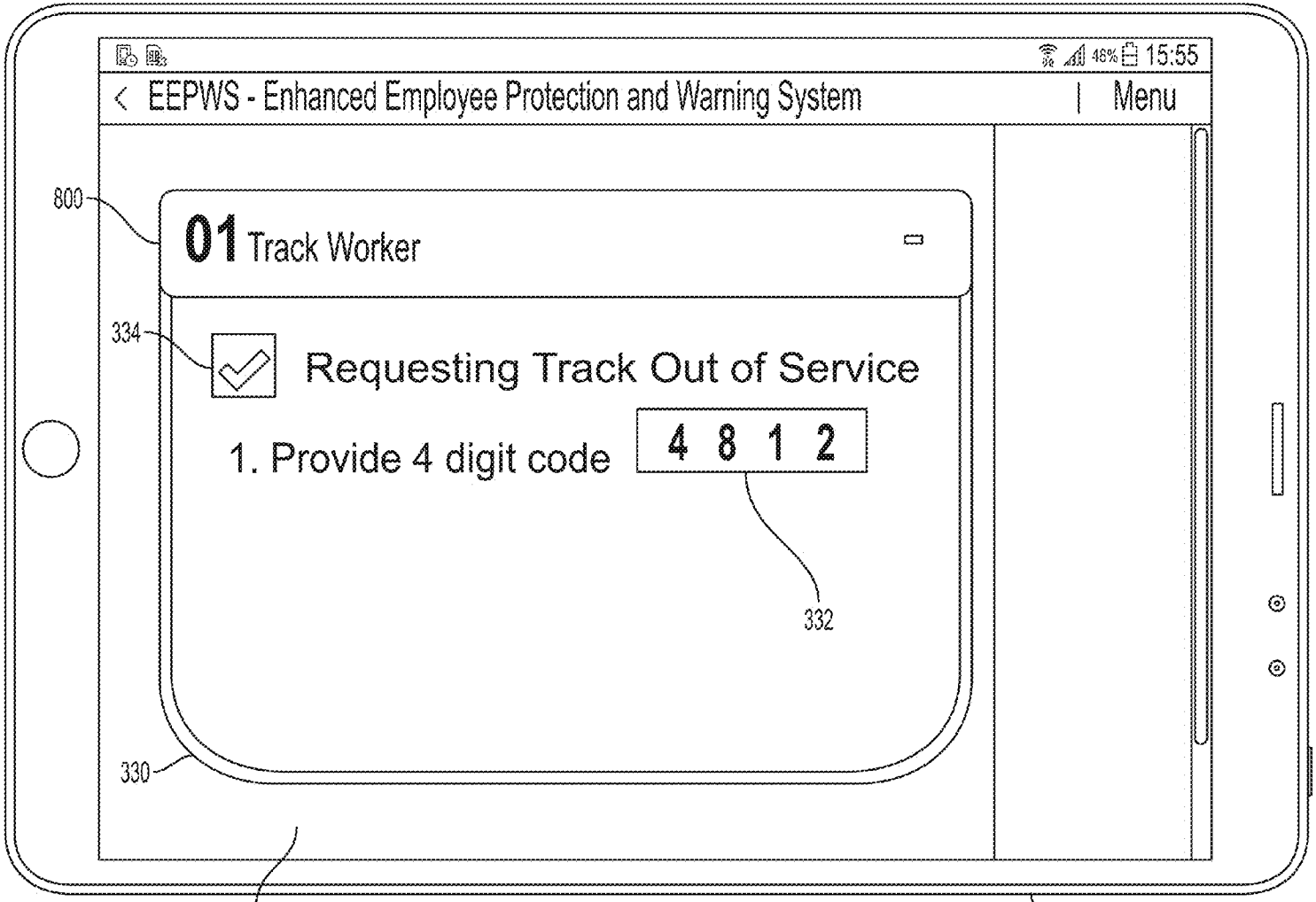
FIG. 5 illustrates the RWIC device displaying a first menu to prompt RWIC input of identification code.

Referring to FIG. 5, the RWIC device 310 subsequently receives the dispatcher's request for required TOOS information, and displays several menus on the screen 312 with which the RWIC 300 may use to supply the required TOOS information. The RWIC device 310 may display a first menu 330 that prompts the RWIC 300 to provide the identification code 250 previously provided to the RWIC 300 from the dispatcher 200 as discussed above. RWIC 300 may enter the identification code 250 into the RWIC device 310 by typing it into a text box 332 and then tapping on a check box 334 of the first menu 330. In an embodiment, after the RWIC 300 enters the identification code 250 into the RWIC device 310, the RWIC device 310 will append the identification code 250 onto the RWIC ID 800 wherever the RWIC ID 800 is subsequently displayed in the RWIC device 310.

Figure 6:
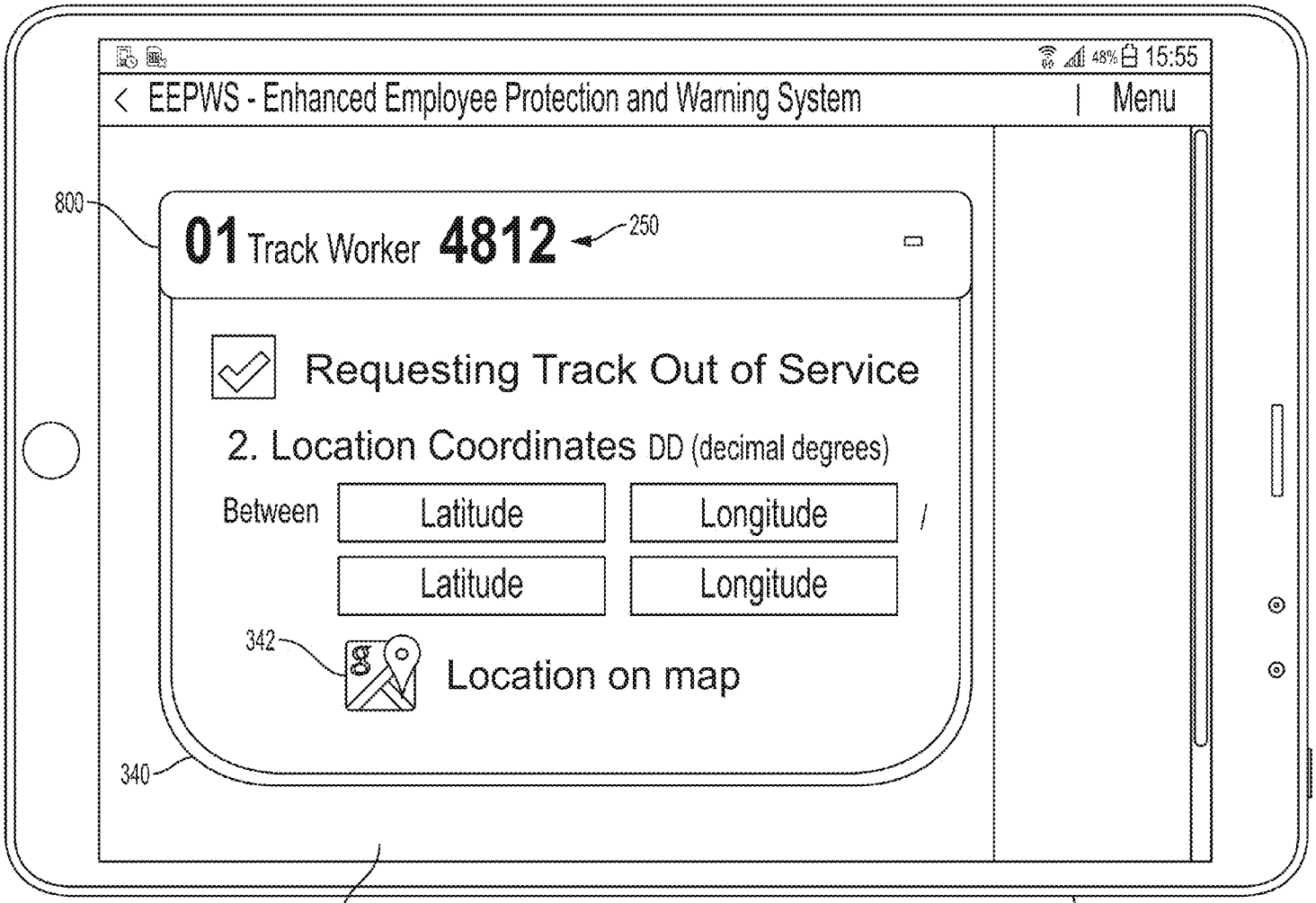
FIG. 6 illustrates the RWIC device displaying a second menu to prompt RWIC input of track location coordinates.

Referring to FIG. 6, after the RWIC 300 enters the identification code 250 into the RWIC device 310, the RWIC device 310 may display a second menu 340 that prompts the RWIC 300 to provide location coordinates of the track that RWIC 300 is requesting to be taken out of service. To facilitate data input, the RWIC 300 may select to identify the location coordinates on a map by selecting a map option 342 on the second menu 340.

Figure 7:
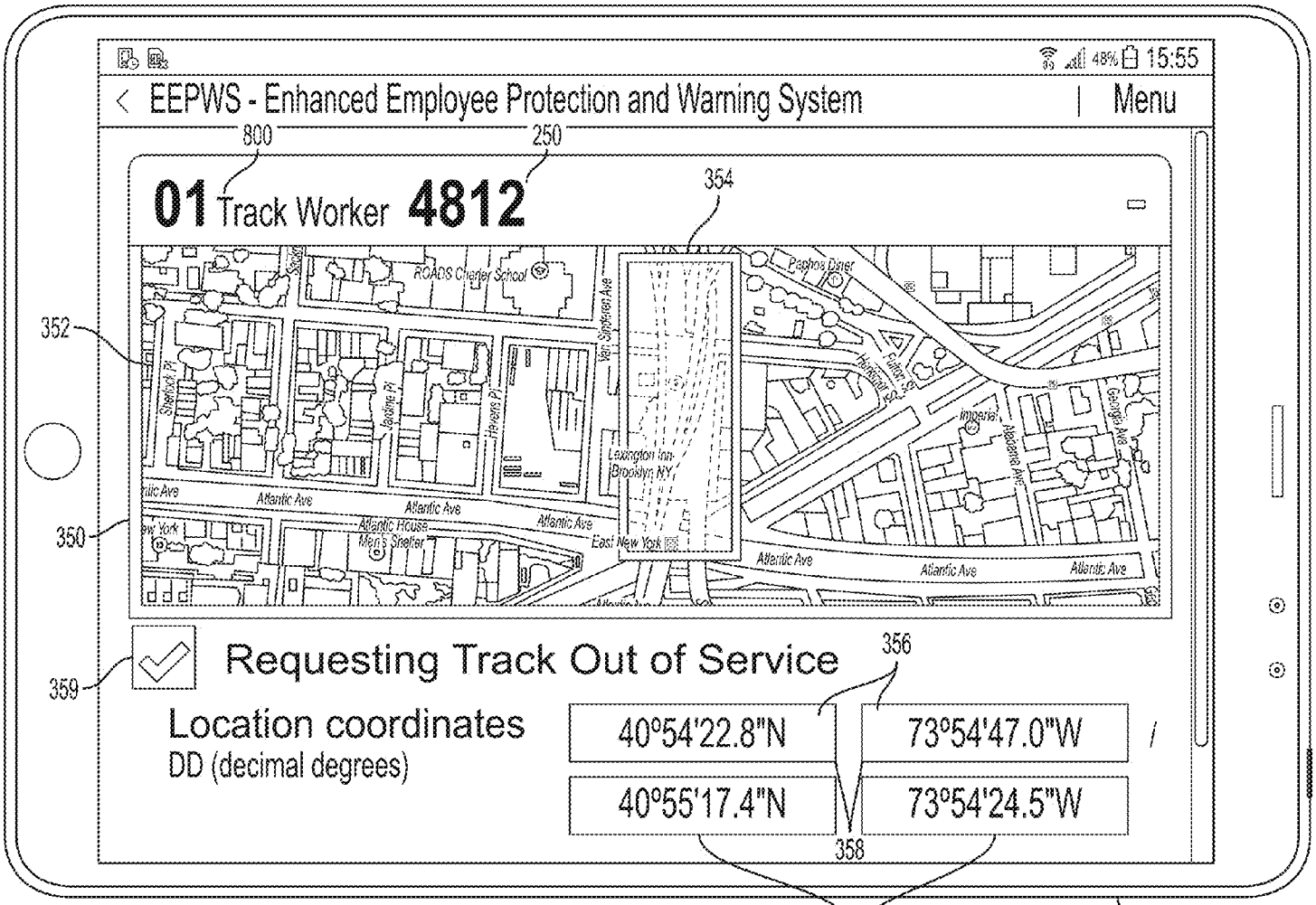
FIG. 7 illustrates the RWIC device displaying a map menu to prompt RWIC selection of track location.

Referring to FIG. 7, after the RWIC 300 selects the map option 342 (see FIG. 6), the RWIC device 310 may subsequently display a map menu 350 showing a map 352 of an area around the job site 700. The RWIC 300 may interact with the map 352 to select an appropriate location 354 where the rail track is to be requested to be taken out of service, and the RWIC device 310 may calculate the longitude and latitude coordinates of the rail track based on the selected location 354. The RWIC device 310 may then automatically populate the coordinates 356 of the selected location 354 into coordinate text boxes 358, at which point the RWIC 300 may enter the coordinates into the RWIC device 310. In an embodiment, the RWIC 300 may enter the coordinates into the RWIC device 310 by tapping on a check box 359 of the map menu 350. In the embodiment shown in FIG. 7, the identification code 250 is appended to the RWIC ID 800 and is displayed with the RWIC ID 800 through out the required TOOS information gathering process.

Figure 8:
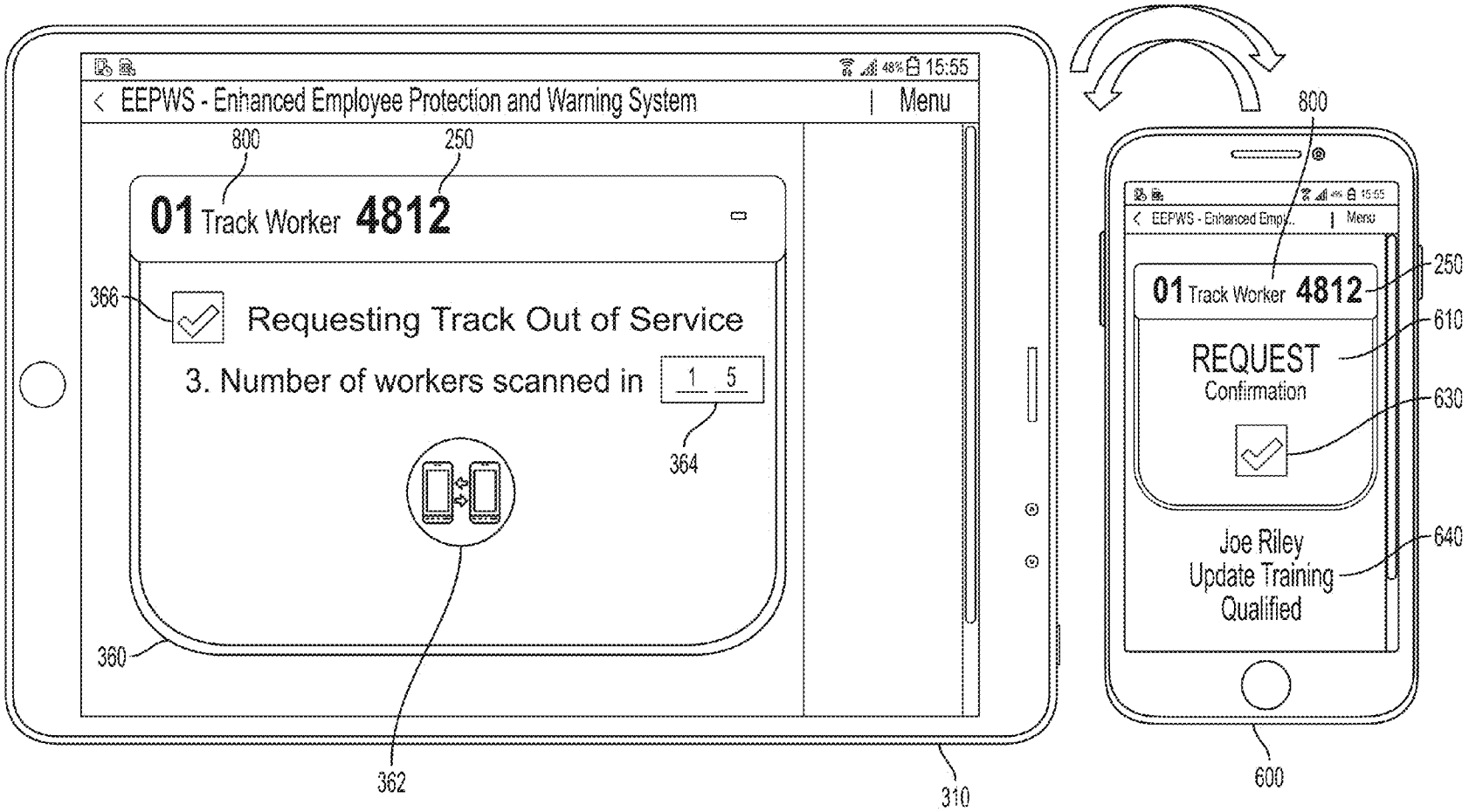
FIG. 8 illustrates the RWIC device displaying a third menu to scan in one or more emergency personnel devices (EPUs), and one EPU according to one embodiment of the present disclosure.

Referring to FIG. 8, the RWIC device 310 may display a third menu 360 used to scan in all EPUs 600 used by rail workers at the job site 700. The RWIC 300 may activate a "scan-in" interface 362, causing the RWIC device 310 to send out a scan-in signal to all EPUs 600 at the job site 700. When one of the EPUs 600 receives the scan-in signal, the EPU 600 may send out an audible alarm through its audio alarm component, display a visual alarm through its visual alarm component 610, and/or produce a physical alarm by vibrating. The rail worker 500 in possession of the EPU 600 may confirm reception of the scan-in signal by interacting with the acknowledgement interface 630. In an embodiment, the rail worker 500 may interact with the acknowledgement interface 630 by tapping on the interface 630 if the interface 630 is a touch screen, pressing on the interface 630 if the interface 630 is a button, or flipping the interface 630 if the interface 630 is a switch. In an embodiment, the EPU 600 may further display a name and personal information 640 of the rail worker in possession of the EPU 600. The EPU 600 may further display the RWIC ID 800 and identification code 250 of the requesting RWIC 300 who manages the job site 700. Furthermore, the EPU 600 may be a smart phone (FIG. 8). As noted above, the EPU 600 may be the device shown in FIG. 1, the smart device shown in FIG. 8, or any other type of device capable of issuing an alarm and receiving a confirmation from the rail worker 500.

After the rail worker 500 confirms reception of the scan-in signal, the EPU 600 sends a scan-in confirmation signal back to the requesting RWIC device 310. The RWIC device 310 may then update a number 364 displayed on the third menu 360, where the number 364 is a real time count of the number of EPUs 600 that sent the scan-in confirmation signal. When all of the rail workers 500 at the job site 700 have scanned in using their respective EPUs 600, the RWIC 300 may enter the number 364 into the RWIC device 310 as a total number of rail workers 500 working at the job site 700. In an embodiment, the RWIC 300 may enter the number 364 by tapping on a check box 366 of the third menu 360. As an example, FIG. 8 shows that the total number of rail workers 500 working at job site 700 is 15.

In an embodiment, the RWIC device 310 may further display a fourth menu to prompt RWIC's confirmation that the RWIC 300 has conducted a safety briefing for all rail workers 500 at the job site 700. The RWIC 300 may confirm that the safety briefing was completed by tapping on a check box on the fourth menu.

In an embodiment, once RWIC device 310 has received all the required TOOS information 222 (FIG. 4) from the RWIC 300, the RWIC device 310 will send the required TOOS information 222 to the dispatcher device 210. As discussed above, the required TOOS information 222 may include RWIC's identification code 250 corresponding to RWIC's RWIC ID 800, coordinates of tracks requested to be taken out of service, total number of rail workers scanned in at the job site 700, and confirmation that RWIC has completed the safety briefing.

Figure 9:
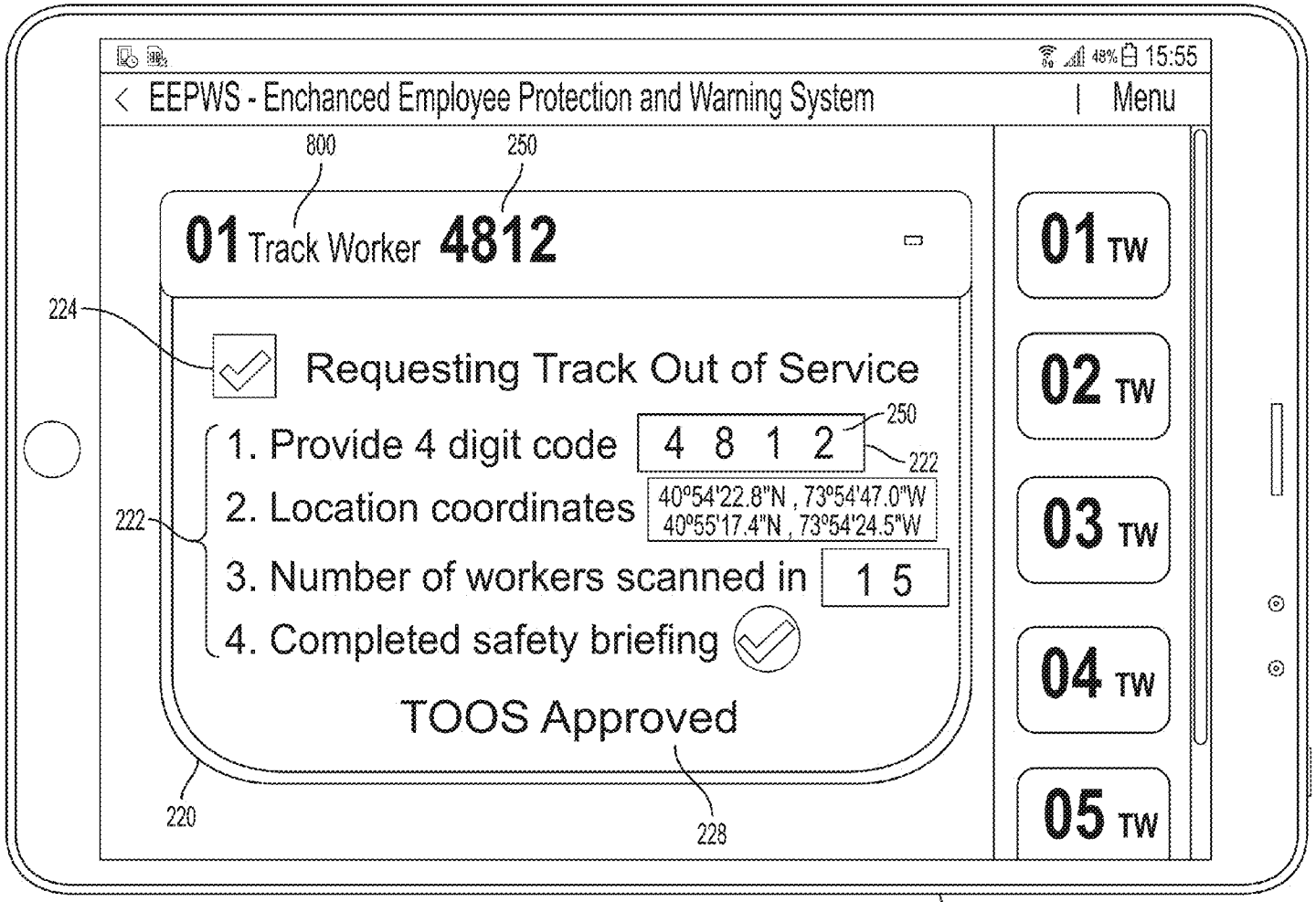
FIG. 9 illustrates the dispatcher device displaying the TOOS menu that has been populated with the required information received from the RWIC device.

Referring to FIG. 9, the dispatcher device 210 may receive and display the required TOOS information 222 onto the TOOS menu 220. In an embodiment, the dispatcher 200 may visually confirm that the identification code 250 received from the RWIC is the same as the identification code 250 that the dispatcher device 210 had generated or had received from the dispatcher computer system 205. This visual confirmation can be done by looking at RWIC's identification code displayed at location 222 of the menu 220, and then looking at dispatcher device's identification code displayed next to the RWIC ID 800. If the two identification codes are the same, then the received TOOS request is from an authorized RWIC 300 and RWIC device 310.

In an embodiment, the dispatcher device 210 may automatically compare the identification code 250 received from the RWIC 300 with the dispatcher device's identification code displayed next to RWIC ID 800. The comparison may be done using latent semantic analysis to determine if occurrences of numerical numbers are the same.

In an embodiment, the dispatcher device 210 has stored an approximate location coordinate of the job site 700. The dispatcher device 210 may determine if the RWIC's submitted coordinates of tracks requested to be taken out of service is within a range of the stored approximate location coordinate of the job site 700.

In an embodiment, the dispatcher device 210 stores a number of rail workers 500 dispatched to the job site 700. The dispatcher device 210 may determine if the stored number of rail works 500 dispatched to the job site 700 is the same as RWIC's submitted total number of rail workers 500 that scanned in at the job site 700.

In an embodiment, the dispatcher device 210 may determine whether RWIC's request to place tracks into TOOS status should be approved. To do so, the dispatcher device 210 may determine that RWIC's submitted identification code matches dispatcher device's identification code, that the RWIC's submitted coordinates of tracks is within a range of the stored approximate location coordinate of the job site, that RWIC's submitted number of scanned in rail workers match the number of rail workers dispatched to the job site, and that the RWIC 300 confirmed completion of the safety briefing. In some embodiments, one or more of these requirements may be removed before approving TOOS. If RWIC's submitted TOOS information 222 is correct, the dispatcher device 210 may display a TOOS approval indicator 228 in the TOOS menu 220. Upon seeing the TOOS approval indicator 228, the dispatcher 200 may approve RWIC's request to place tracks into TOOS status. In an embodiment, the dispatcher 200 may approve RWIC's TOOS request by tapping on the check box 224 when the TOOS approval indicator 228 is active.

After the dispatcher 200 approves of RWIC's TOOS request, the rail track at the requested coordinates will be taken out of service. The dispatcher device 210 will store within its storage that the RWIC 300 having RWIC ID 800 and identification code 250 is currently working on a job site 700 with TOOS status. The dispatcher device 210 may visually indicate, on the main PWS dispatcher interface shown in FIG. 2, that the track of the RWIC 300 has a "TOOS" status. In an embodiment, the RWIC ID 800 of the RWIC 300 may be displayed in different colors in the main PWD dispatcher interface to indicate that the track corresponding to the RWIC 300 is out of service.

In an embodiment, after the dispatcher 200 approves of RWIC's TOOS request, the RWIC device 310 may display the RWIC ID 800 corresponding to the RWIC device 310. The RWIC ID 800 will be displayed in a specific color to indicate that the track corresponding to the RWIC ID 800 is out of service.

After the RWIC 300 receives TOOS approval and the requested track is taken out of service, rail workers 500 at the job site 700 may proceed to perform track work. The RWIC 300 may further interact with the RWIC device 310 depending on the status of the job site 700.

Figure 10:
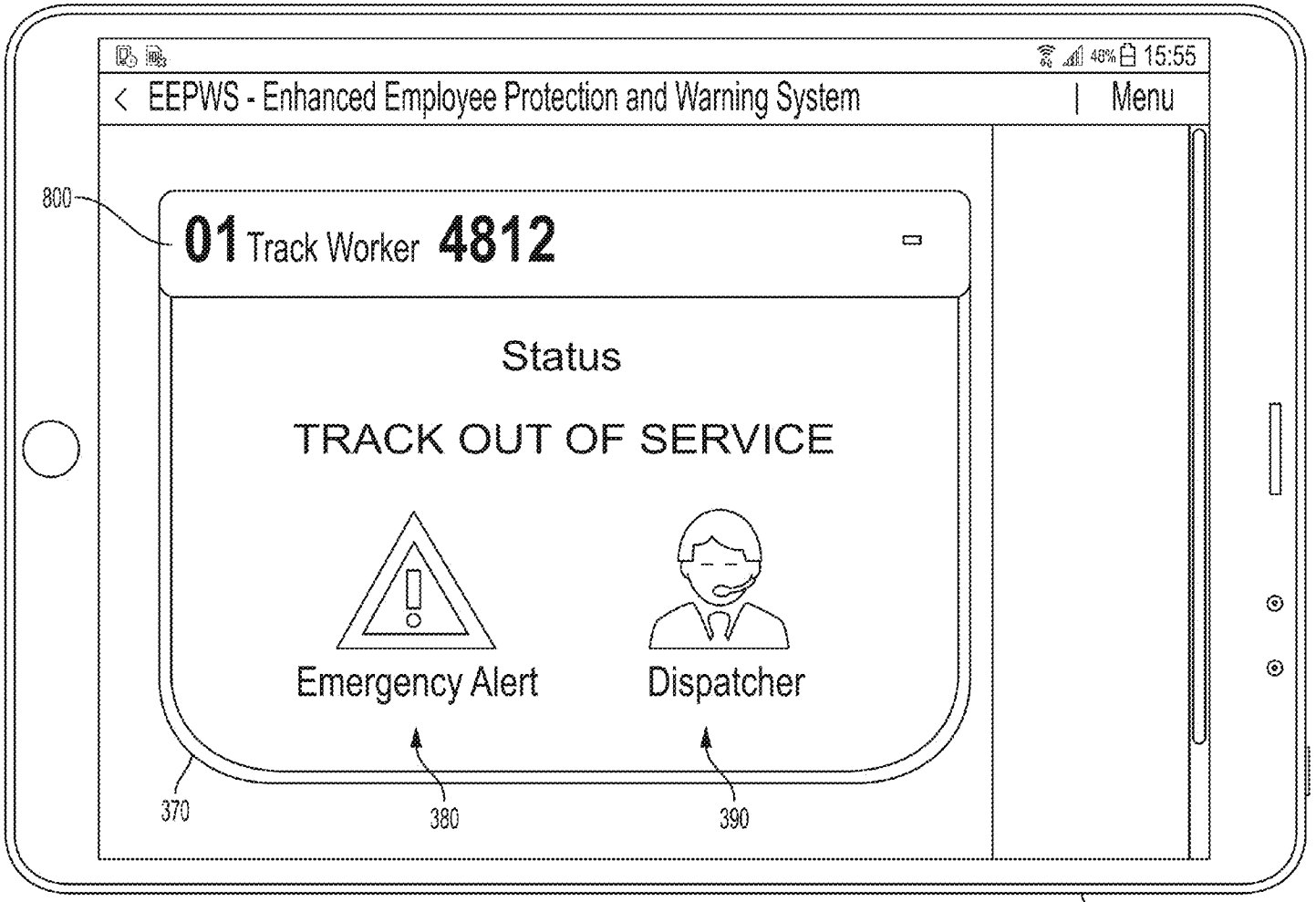
FIG. 10 illustrates the RWIC device displaying a TOOS status menu.

Referring to FIG. 10, the RWIC may tap on the RWIC ID 800 on the RWIC device 310 while the track of the job site 700 is out of service. The RWIC device 310, recognizing that the job site 700 has TOOS status enabled, will display a RWIC TOOS status menu 370. This menu 370 may include an emergency interface 380 for issuing an emergency alert, and a dispatcher interface 390 for the RWIC 300 to contact the dispatcher 200. The RWIC 300 may select either interface under the appropriate circumstances.

When the RWIC 300 of the job site 700 learns of a dangerous track condition (e.g. a train coming into the job site even though the tracks have been set as out of service), the RWIC 300 may issue a general emergency alert to all rail workers 500 using the RWIC device 310. To do so, the RWIC 300 may tap on the emergency interface 380 to prompt the RWIC device 310 to send an emergency signal to all EPUs 600 in the job site 700.

Figure 11:
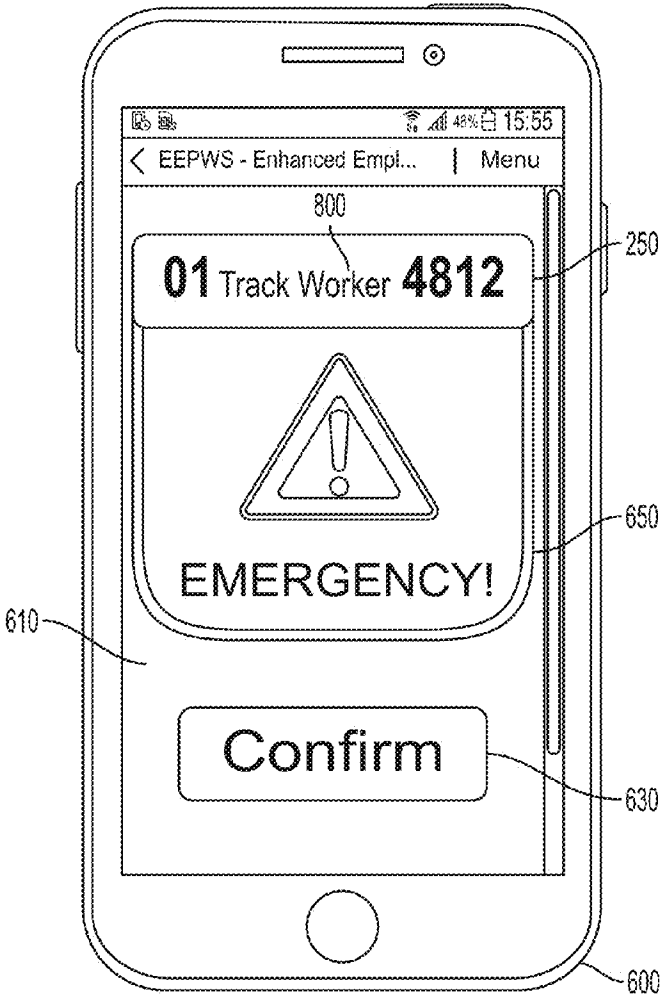
FIG. 11 illustrates the EPU after receiving an emergency signal according to one embodiment of the present disclosure.

Referring now to FIG. 11, when each EPU 600 receive the emergency signal, each EPU 600 may send out an emergency audible alarm through its audio alarm component, display an emergency visual alarm 650 using its visual alarm component 610, and/or vibrate to provide a physical alarm. As discussed above, although FIG. 11 discloses the EPU 600 as a smartphone where the visual alarm component 610 is a touch screen and the emergency visual alarm 650 is an emergency menu, the EPU 600 may also be a mechanical device shown in FIG. 1 where the visual alarm component 610 is a number of lights and the emergency visual alarm may be flashing of the lights. In either case, the rail worker 500 in possession of the EPU 600 may confirm receipt of the emergency signal by interacting with the acknowledgement interface 630. In an embodiment, the rail worker 500 may interact with the acknowledgement interface 630 by tapping on the interface 630 if the interface 630 is a touch screen (FIG. 11), pressing on the interface 630 if the interface 630 is a button (FIG. 1), or flipping the interface if the interface is a switch.

Figure 12:
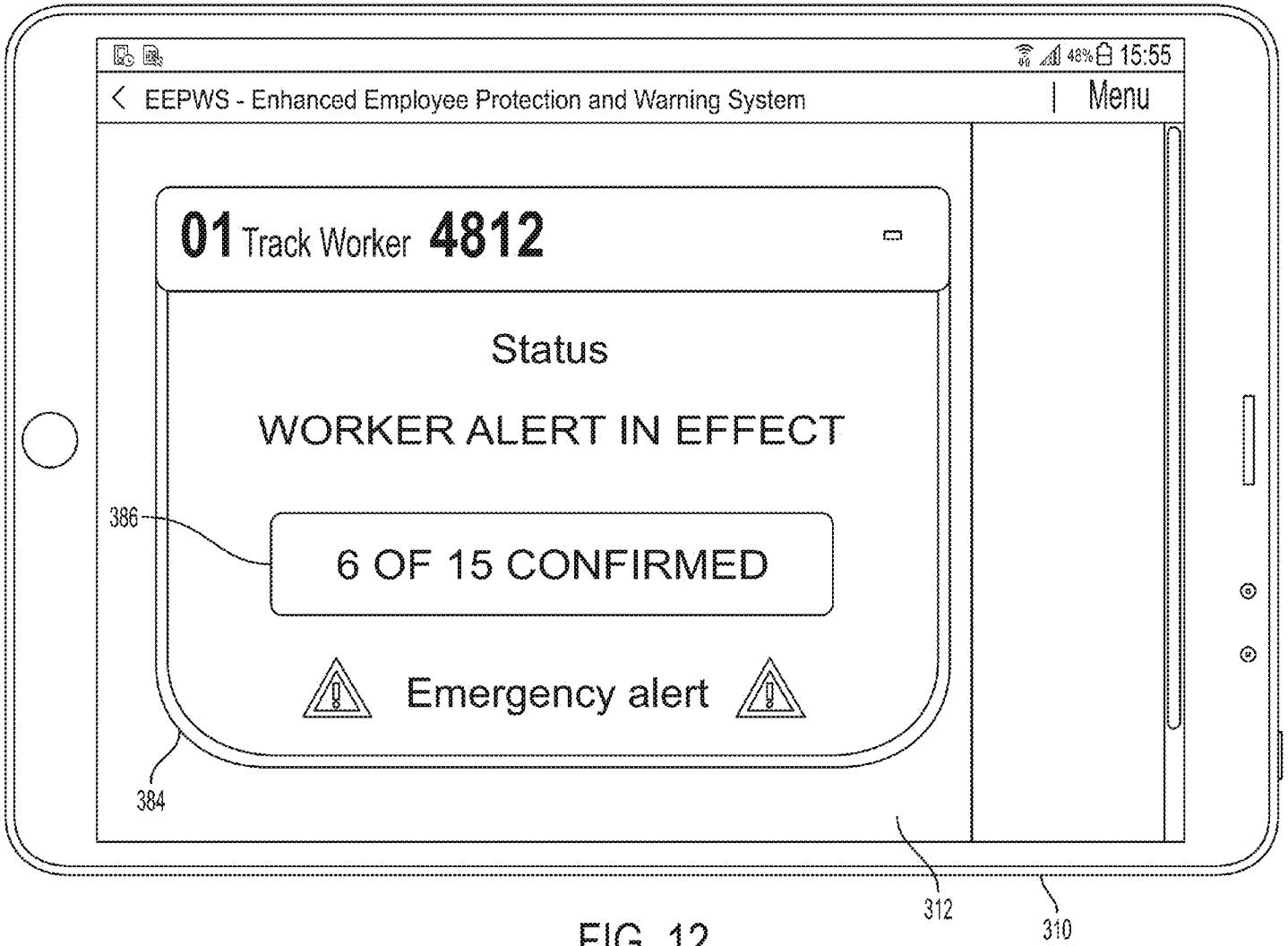
FIG. 12 illustrates the RWIC device displaying an emergency alert menu.

Referring to FIG. 12, after the rail worker 500 confirms reception of the emergency alert by interacting with the acknowledgement interface 630, the rail worker's EPU 600 will send an emergency confirmation signal to the RWIC device 310. As the RWIC device 310 receives emergency confirmation signals from the EPUs 600, the RWIC device 310 may update a number of workers 386 who has confirmed receipt of the emergency signal in real time, and display the number in an emergency alert menu 384 displayed on the RWIC device's screen 312.

In an embodiment, when RWIC 300 taps on the emergency interface 380 of the RWIC device 310 in FIG. 10, the RWIC device 310 not only sends the emergency signals to the EPUs, but also sends the emergency signal to the dispatcher device 210.

Figure 13:
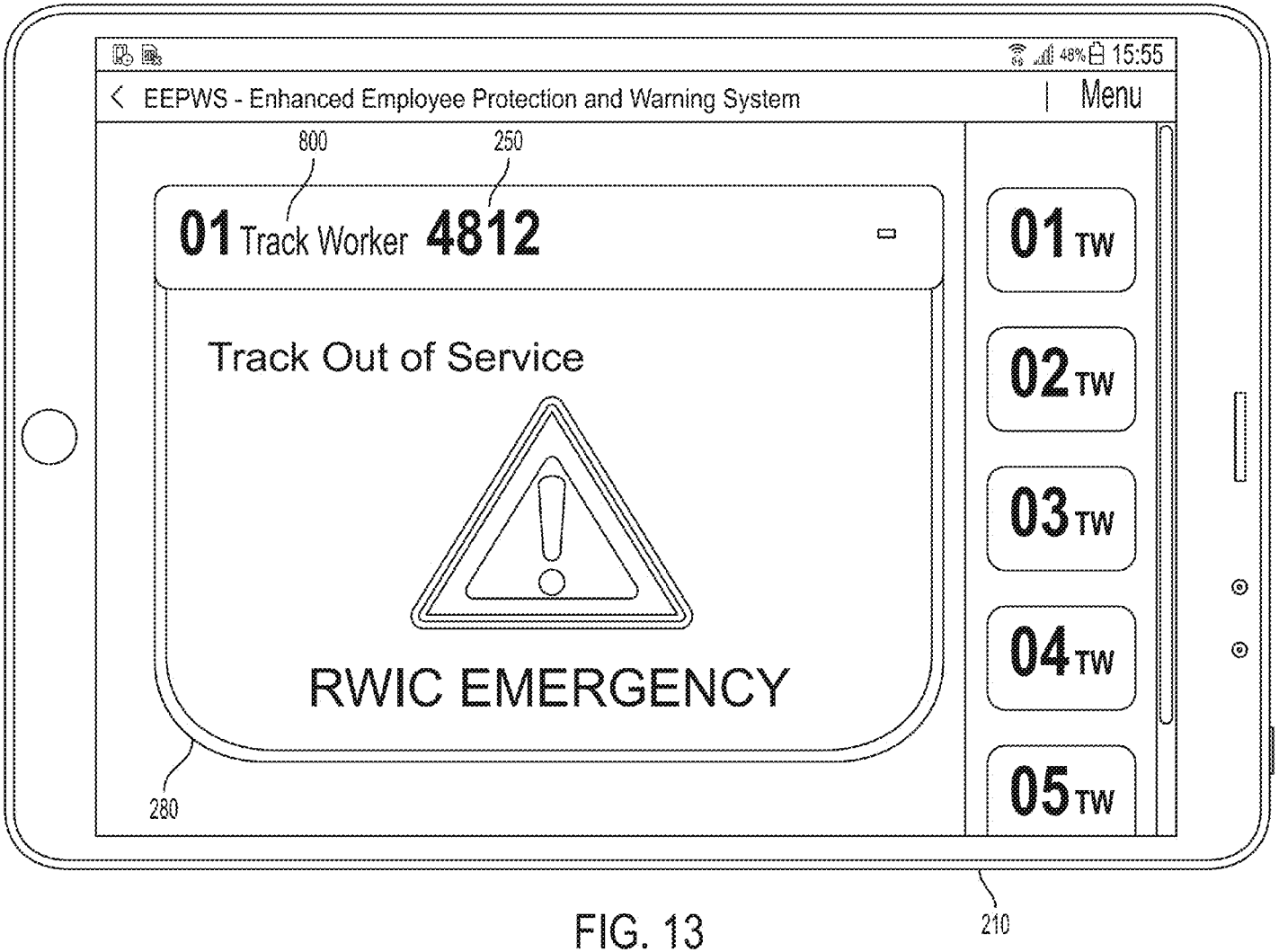
FIG. 13 illustrates the dispatcher device displaying a dispatcher emergency menu.

Referring to FIG. 13, when the dispatcher device 210 receives the emergency signal from the RWIC device 310, the dispatcher device 210 displays a dispatcher emergency menu 280 under the displayed RWIC ID 800 and code 250 corresponding to the RWIC Device 310 that sent the emergency signal. This way, the dispatcher 200 receives the information that the job site 700 managed by RWIC 300 having an RWIC ID of "01 Track Worker" is having an emergency situation. The dispatcher 200 may then act accordingly to deal with the emergency situation.

Referring back to FIG. 10, if the RWIC 300 need not report any emergency situations, the RWIC may choose to contact the dispatcher 200 at the completion of a job so that the tracks may be placed back into service. To do so, the RWIC 300 may tap on the dispatcher interface 390 to indicate that the RWIC 300 wants to contact the dispatcher 200.

Figure 14:
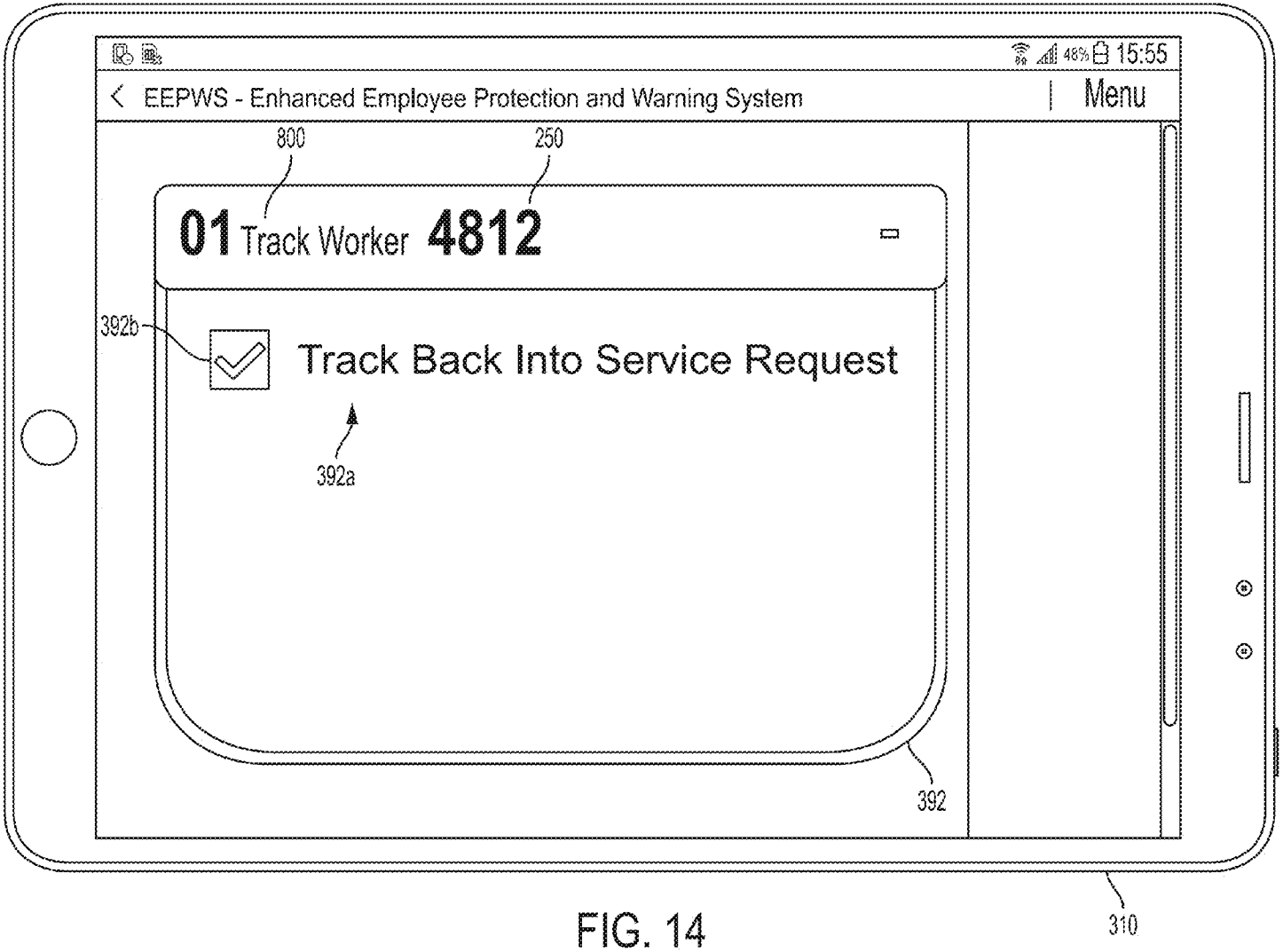
FIG. 14 illustrates the RWIC device displaying a dispatcher interface menu.

Referring to FIG. 14, the RWIC device 310, in response to the RWIC 300 activating the dispatcher interface 390, will display a dispatcher interface menu 392. The dispatcher interface menu 392 includes a "Track Back into Service Request" option 392*a*. The RWIC 300 may tap on a check box 392*b* corresponding to the "back in service" request 392*a* to indicate to the RWIC device 310 that the RWIC would like to send the "back in service" request to the dispatcher 200.

Figure 15:
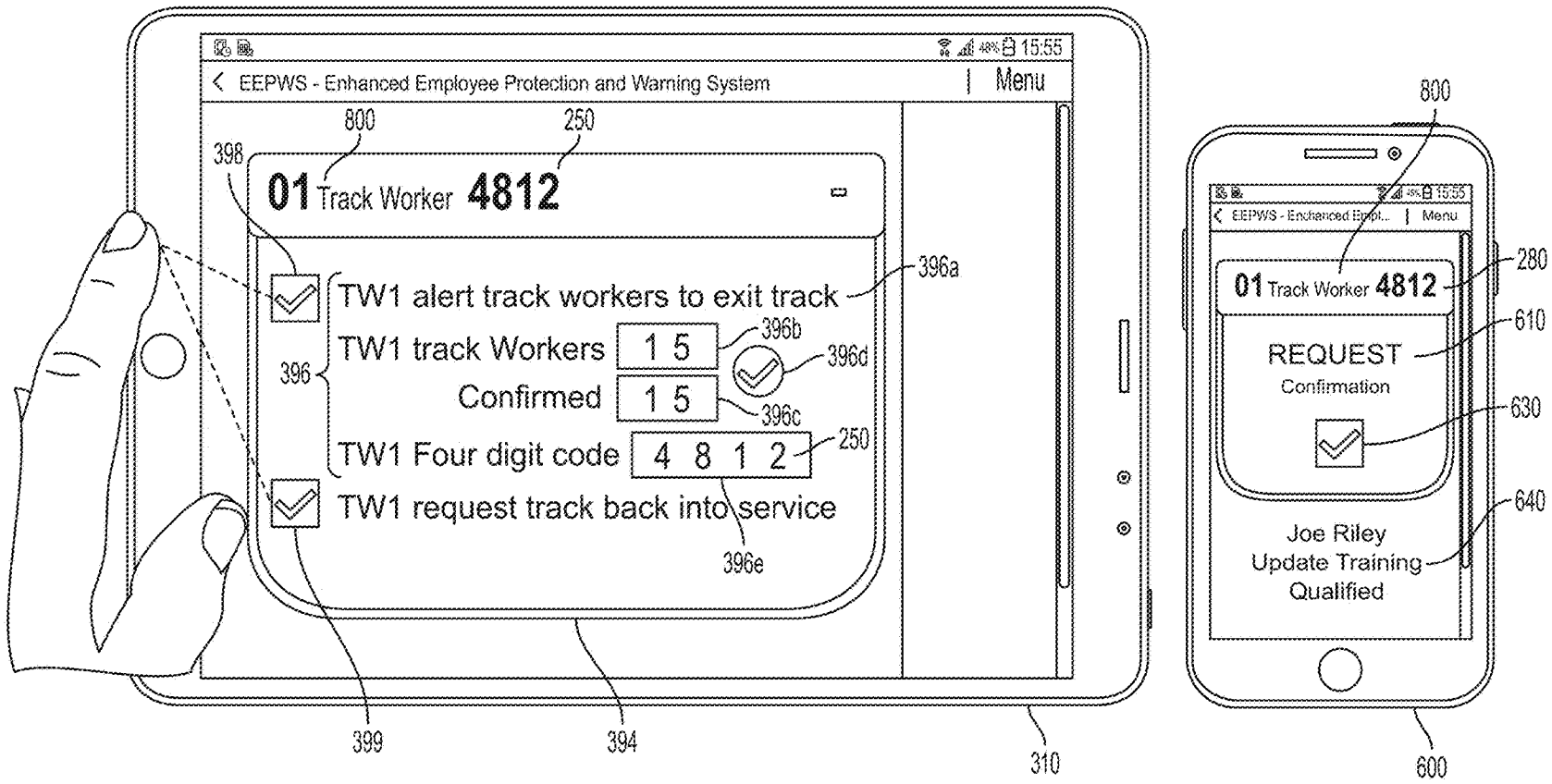
FIG. 15 illustrates the RWIC device displaying a track return task list menu, and the EPU.

Referring to FIG. 15, after RWIC 300 taps on the check box 392*b* of FIG. 14, the RWIC device 310 may display a track return task list menu 394 having a list of tasks 396. The list may include a task whereby RWIC 300 must alert the rail workers to exit the track 396*a*, confirm that all rail workers have confirmed receipt of the exit track alert 396*d*, and provide identification code 250 to confirm that RWIC 300 is authorized to submit such a request. After the list of task is completed, the RWIC 300 may properly request the dispatcher 200 that the track be placed back into service.

The RWIC 300 may alert the rail workers to exit the track before the track is returned to service. In an embodiment, the RWIC 300 sends an exit track alert to all rail workers 500 by tapping on an exit track alert check box 398 in the task list menu 294, whereby the RWIC device 310 sends an exit track signal to all EPUs 600 of the job site 700. When each of the EPU 600 receives the exit track signal from the RWIC device 310, each EPU 600 may send out an audible alarm through its audio alarm component, display a visual alarm through its visual alarm component 610, and/or vibrate to provide a physical alarm. The rail worker 500 in possession of the EPU 600 may confirm reception of the exit track signal by interacting with the acknowledgement interface 630. As discussed above, the rail worker 500 may interact with the acknowledgement interface 630 by tapping on the interface 630 if the interface 630 is a touch screen (FIG. 11), pressing on the interface 630 if the interface 630 is a button (FIG. 1), or flipping the interface if the interface is a switch. Also as discussed above, the EPU 600 may further display a name and personal information 640 of the rail worker 500 in possession of the EPU. The EPU 600 may further display the RWIC ID 800 and identification code 250 of the requesting RWIC who manages the job site 700. Furthermore, the EPU 600 may be a smart phone (FIG. 8). As noted above, the EPU 600 may be the device shown in FIG. 1, the smart device shown in FIG. 8, or any other type of device capable of issuing an alarm and receiving a confirmation from the rail worker 500.

After the rail worker 500 confirms reception of the exit track signal by interacting with the acknowledgement interface 630, the rail worker's EPU 600 will send an exit track confirmation signal to the RWIC device 310. The RWIC device 310 receives the exit track confirmation signal from the EPUs 600 and updates, in real time, a number of workers 396*b* that has confirmed receipt of the exit track signal. The RWIC device 310 may further display the total number of worker 396*c* at the job site so that the RWIC 300 may easily and visually note whether all rail workers 500 have confirmed receipt of the exit track signal. In an embodiment, the RWIC device 310 may compare the total number of rail workers 500 at the job site 700 to the number of workers who has confirmed receipt of the exit track signal in real time. When the RWIC device 310 determines that all of the workers have confirmed to have received the exit track signal, the RWIC device may visually display a confirmation 396*d*. As an example, in the instant embodiment the RWIC device visually shows a check mark 396*d* when all 15 workers at the job site 700 confirmed receipt of the exit track signal.

RWIC may further be requested to provide identification code 250 to confirm RWIC's identify. To do so, RWIC may input the code 250 into a text box 396*e* of the task list menu 394.

After the RWIC 300 has alerted the rail workers to exit the track, confirmed that all rail workers have received the exit track alert, and provided the identification code to confirm RWIC's identity, the RWIC 300 may submit the request to return track back into service. In an embodiment, the RWIC 300 may submit the request by tapping on a request check box 399 of the task list menu 394. The RWIC device 310 will then send the "back in service" request signal to the dispatcher device 210. In an embodiment, the "back in service" request signal may include all of the task list information 396 provided by the RWIC 300. In other words, the "back in service" request signal may include information regarding the number of rail workers who has confirmed receipt of the exit track signal, the total number of rail workers who works at the job site, and the RWIC's identification code.

In an embodiment, when the dispatcher device 210 receives the "back in service" request signal, the dispatcher device 210 is displaying the main PWS dispatcher interface shown in FIG. 2. As discussed above, the RWIC ID 800 displayed on the main PWS dispatcher interface reflects the status of each job site related to the RWIC ID. In an embodiment, the RWIC ID 800 having an ID of "01 Track Worker" is in a color that indicates that the corresponding job site is under a TOOS status where the track is out of service. For example, the dispatcher 200 may easily identify that the track at the RWIC "01 Track Worker" job site is out of service because RWIC ID "01 Track Worker" is in red.

Figure 16:
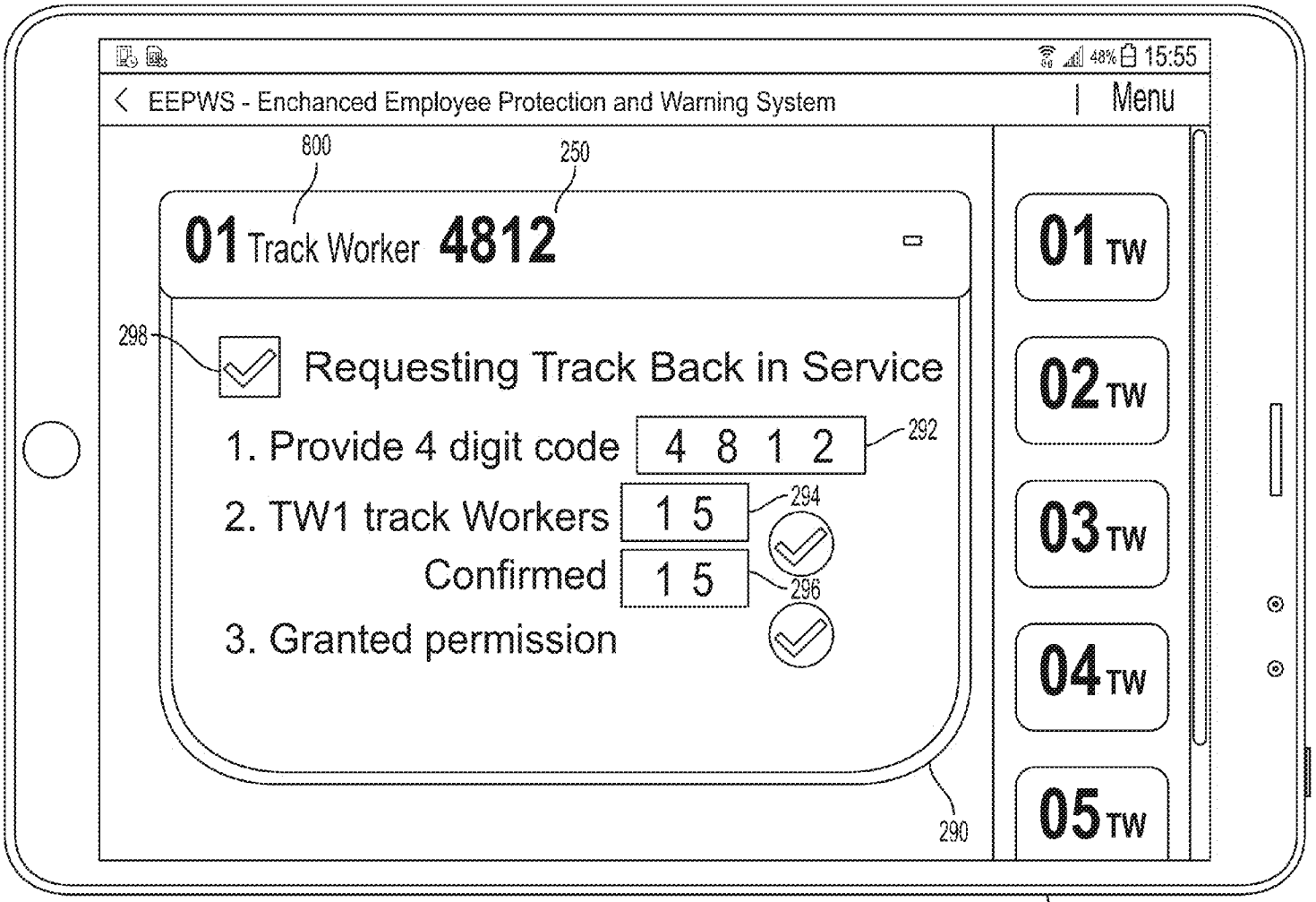
FIG. 16 illustrates the dispatcher device displaying a dispatcher track return menu.

Referring to FIG. 16, when the dispatcher device 210 receives the "back in service" request signal from the RWIC device 310, the dispatcher device 210 may issue an audible alarm. In addition, the dispatcher device 210 may also visually indicate to the dispatcher 200, through flashing of the RWIC ID 800, that a request for dispatcher action has been received from the RWIC device having RWIC ID 800. The dispatcher 200 may tap on the RWIC ID 800 displayed on the main PWS dispatcher interface to open up a dispatcher track return menu 290. The dispatcher track return menu 290 includes an identification code text box 292, total rail worker text box 294, and exit signal confirmation text box 296, where these text boxes may be automatically populated using data embedded in the "back in service" request signal. Specifically, the dispatcher track return menu 290 may display the number of total workers at the job site, the number of workers who's confirmed receipt of exit track signal, and RWIC's identification code. If the dispatcher 200 determines that all of the rail workers 500 of the job site 700 have confirmed receipt of the exit track signal and that RWIC's provided identification code is the correct code that corresponds to RWIC ID 800, the dispatcher 200 may change the track status from out of service to back in service. The change in track status may be completed when the dispatcher 200 taps on a check box 298 of the dispatcher track return menu 290. At this point, the trains at the job site may return to normal operation.

Figure 17:
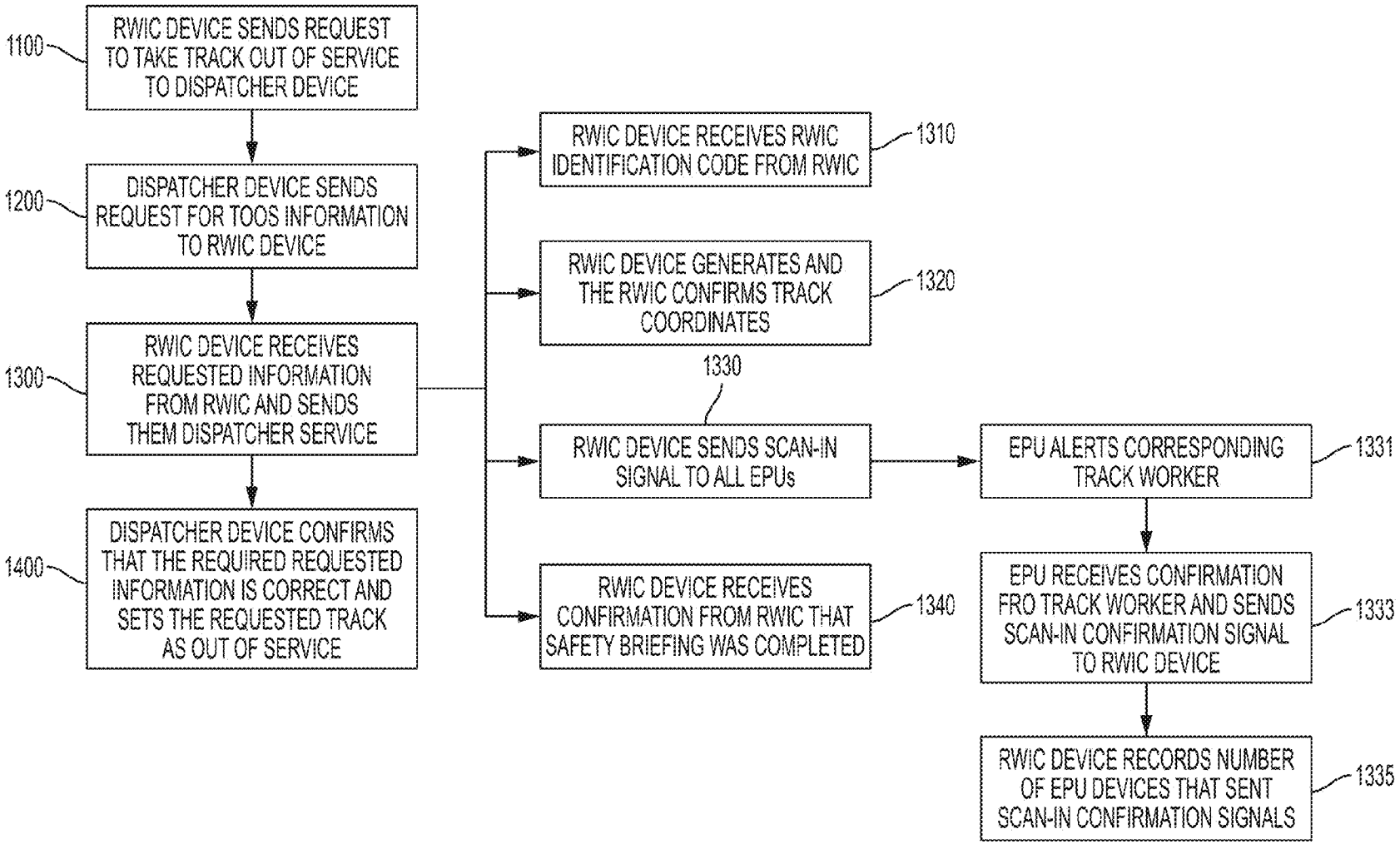
FIG. 17 illustrates how the RWIC requests and receives TOOS approval from the dispatcher.

Referring to FIG. 17, the method of requesting and placing a section of rail track to be "out of service" as described above will be further discussed. First, the RWIC 300 uses the RWIC device 210 to send a TOOS request to the dispatcher device 210 (1100). The dispatcher 200, upon viewing the request on the dispatcher device 210, sends a request for required TOOS information to the RWIC device 310 using the dispatcher device 210 (1200). The RWIC device 310 then prompts and receives from the RWIC 300 the required TOOS information (1300), which includes RWIC identification code, TOOS track coordinates, total number of scanned-in rail workers, and confirmation that safety briefing was completed. To provide RWIC device 310 with the RWIC identification code 250, the RWIC 300 inputs the RWIC's identification code into the RWIC device 310 (1310). To provide RWIC device 310 with the TOOS track coordinates, the RWIC 300 may select, on a map provided by the RWIC device 310, the track the RWIC would like to be taken out of service. Based on RWIC's selection, the RWIC device 310 may generate a set of track coordinates, where the RWIC 300 may confirm the track coordinates and enter them into the RWIC device (1320). To provide the total number of scanned-in rail workers, the RWIC device 310 may send scan-in signals to all EPUs 600 (1330). The EPUs 600, after receiving the scan-in signal, will each alert the rail worker 500 in possession of the corresponding EPU 600 (1331). The EPUs 600, after receiving a confirmation from the corresponding rail worker 500, will send a scan-in confirmation signal to the RWIC device (1333). The RWIC device 310 records, in real time, the number of EPU devices 600 that sent the scan-in conformation, until the total number of received confirmations is the same as the total number of rail workers 500 on the job site 700 (1335). To provide the RWIC device 310 with confirmation that safety briefing was complete, the RWIC 300 may input such a confirmation into the RWIC device 310 (1340). Once all of the required TOOS information is entered into the RWIC device 310, the RWIC device 310 sends them to the dispatcher device 210 (1300). Subsequently, the dispatcher device 210 can confirm that the RWIC identification code 250 is correct, that the requested track coordinates were provided, that RWIC 300 provided the total number of rail workers 500 at the job site 700 by providing a number of scanned rail workers 500 for the given track, and that safety briefing was completed. Upon confirmation, the dispatcher device 210 sets the requested track to have TOOS status, and the track is now considered "out of service" (1400).

Figure 18:
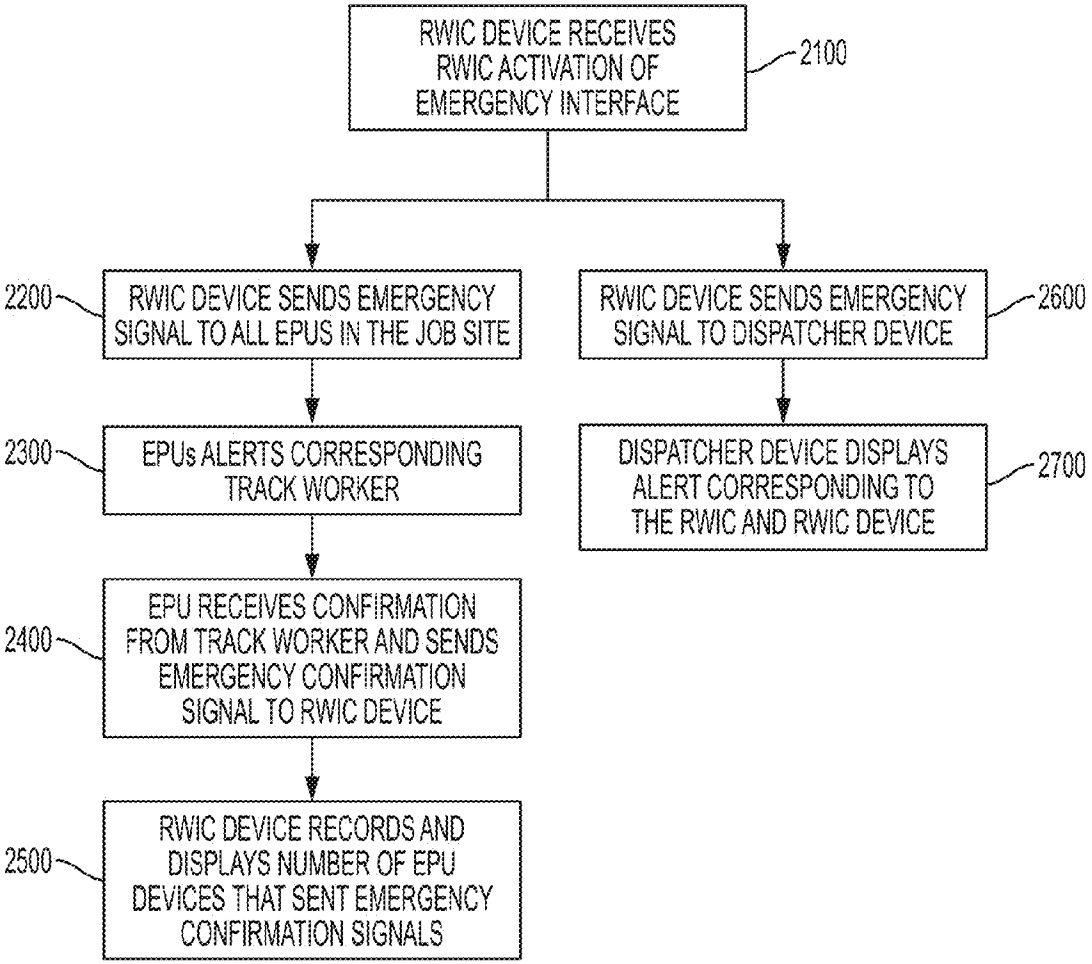
FIG. 18 illustrates how the RWIC issues an emergency signal to EPUs and the dispatcher device.

Referring to FIG. 18, a method of issuing an emergency alert to the rail workers 500 of the job site 700 is disclosed. To issue an emergency alert, the RWIC device 310 must first receive a RWIC request to issue emergency alert, where the request may be in the form of activating the emergency interface of the RWIC device 310 (2100). The RWIC device 310 will then send the emergency signal to all EPUs 600 on the job site 700 (2200) and the dispatcher device 210 (2600). The EPU 600, after receiving the emergency signal, alerts the corresponding rail worker 500 of the emergency situation (2300). The alerted rail worker 500 may confirm receipt of the alert by interacting with the EPU 600 (e.g. pressing an acknowledgement button 630), whereupon the EPU 600 will send an emergency confirmation signal to the RWIC device (2400). The RWIC device 310 receives the emergency confirmation signal of each EPU 600 and records and displays the number of EPUs that has sent confirmation (2500). The dispatcher device 210, after receiving the emergency signal from the RWIC 300, may display an alert to the dispatcher 200 (2700).

Figure 19:
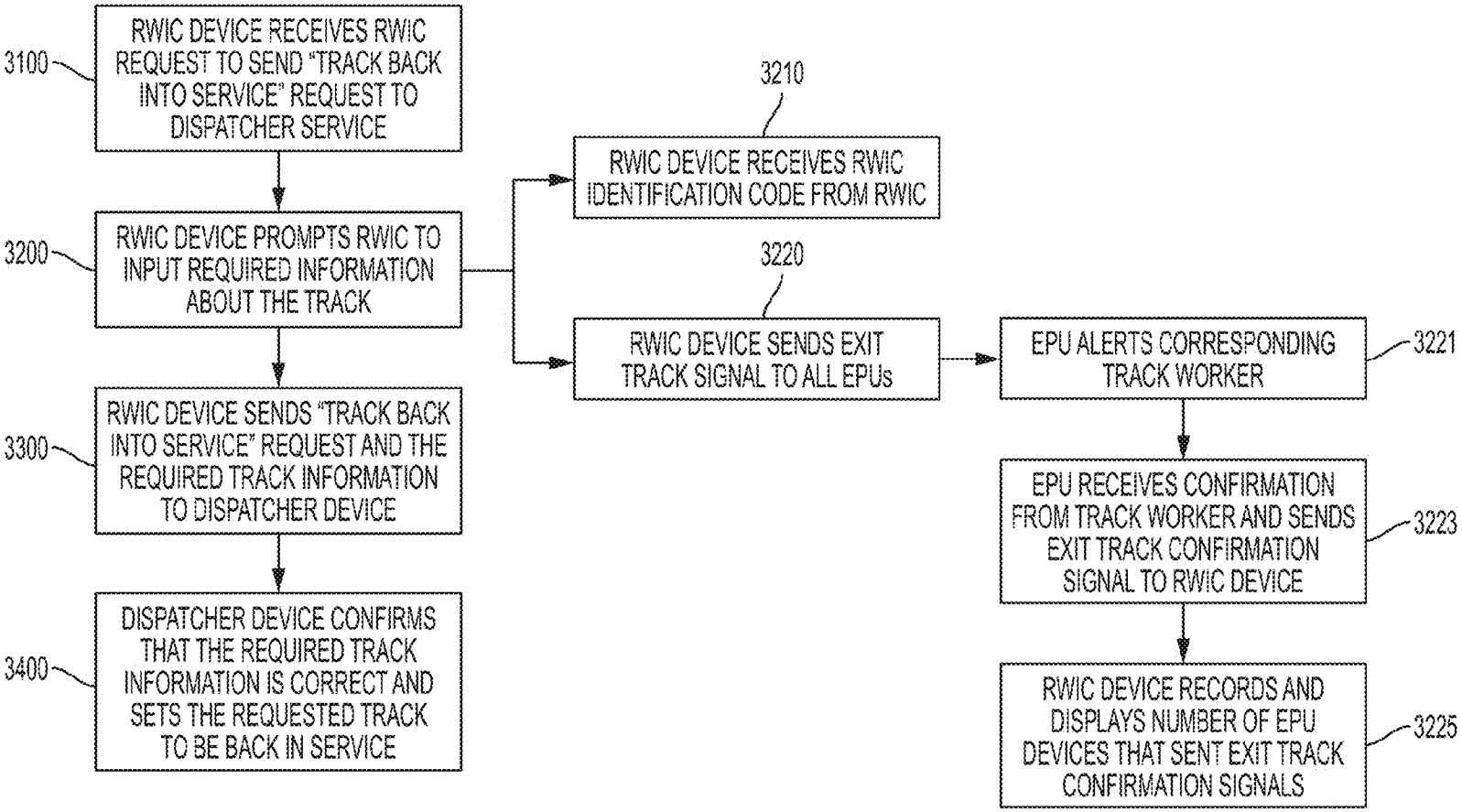
FIG. 19 illustrates how the RWIC requests and receives track back to service request from the dispatcher.

Referring to FIG. 19, a method of requesting the out of service track to be placed back into service will now be disclosed. To request that an out of service track be placed back into service ("track return" request), the RWIC 300 will input the request into the RWIC device 310 (3100). Thereafter, the RWIC device 310 will prompt the RWIC 300 to input the required information for the track return request, where the required information includes the RWIC identification code 250 and that all rail workers 500 of the job site 700 has confirmed that they've exited the track area (3200). To receive RWIC's identification code 250, the RWIC 300 inputs the identification code 250 into the RWIC device (3210) 310. To confirm that all rail workers have exited the track area, the RWIC device 310 sends exit track signals to all EPUs 600 (3220). The EPUs 600, after receiving the exit track signals, will each alert the corresponding rail worker 500 (3221). Each worker 500 may then confirm receipt of the alert, and the EPU 600 will send an exit track confirmation signal to the RWIC device 310 (3223). The RWIC device 310 records and displays the total number of EPU devices 600 that sent the exit track confirmation (3225). When number of EPUs 600 that sent the exit track confirmation is equal to the total number scanned-in EPUs 600, and the RWIC device 310 received the RWIC identification code 250, the RWIC device 310 would have received all of the required track return information. At this point, the RWIC device 310 will then send the track return request and the required track return information to the dispatcher device 210 (3300). Once the dispatcher device 210 determines that the received required track return information is correct (e.g. that the RWIC identification code 250 is correct and that all of the workers have confirmed exiting the track), the dispatcher 200 may set the requested track to be back in service (3400).

In an embodiment of the disclosure, if the tracks are un-safe or track is placed back into service, the EPUs 600 will automatically emit audible and visual alarm so that the rail workers 500 may clear the tracks. Also in an embodiment of the disclosure, the EPUs 600, master unit 400, RWIC device 310, the dispatcher device 210, and the dispatcher computer system 205 include computer-readable mediums, where all activities are logged and stored into some or all of the computer-readable mediums.

While various embodiments in accordance with the disclosed principles have been described above, it should be understood that they have been presented by way of example only, and are not limiting. For example, communications described herein may be transmitted through existing radio systems of the transit agencies, for example, through walkie-talkies of such systems. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

What is claimed is:

1. A method for providing rail worker safety, comprising:

transmitting a first request to take a section of railroad track out of service, the first request being sent from a first rail worker device to a dispatcher device;

transmitting a second request for job site information from the dispatcher device to the first rail worker device;

inputting job site information responsive to the second request into the first rail worker device, wherein the job site information includes an identification code, a location coordinate, and one or more scan-in confirmation signals;

transmitting the job site information to the dispatcher device from the first rail worker device; and displaying a notification on the dispatcher device that the first request is approved.

2. The method of claim 1, wherein the identification code is a four digit numerical code generated by the dispatcher device.

3. The method of claim 1, wherein the identification code is generated by the dispatcher device and transmitted to the first rail worker device.

4. The method of claim 1, further comprising: comparing the identification code with an identification code stored within the dispatcher device.

5. The method of claim 1, wherein the location coordinate is generated by the first rail worker device when a user selects a location on a displayed map.

6. The method of claim 1, wherein each of the one or more scan-in confirmation signals is generated by one or more emergency personnel units respectively, and that each of the one or more emergency personnel units is assigned to a rail worker.

7. The method of claim 6, wherein each of the one or more scan-in confirmation signals is generated by the one or more emergency personnel units when the rail worker assigned to the emergency personnel unit interacts with an acknowledgement interface of the emergency personnel unit.

8. The method of claim 1, wherein the section of railroad track requested to be taken out of service is determined by the location coordinate.

9. A rail worker protection system comprising:

a first device having a display screen and configured to generate and send an identification code to a second device;

the second device having a display screen and configured to transmit a first request to the first device, to transmit a job site information to the first device and to transmit a remote device signal to a third device configured to receive the remote device signal from the second device and transmit a reinforced remote device signal to a fourth device; and the fourth device having an alarm component and an acknowledgement interface, the fourth device configured to issue an alarm with the alarm component, and to transmit a confirmation signal when a rail worker interacts with the acknowledgement interface.

10. The rail worker protection system according to claim 9, wherein the fourth device issues the alarm in response to receiving the reinforced remote device signal.

11. The rail worker protection system according to claim 9, wherein the alarm is one of a group consisting of a scan-in alarm, an emergency alarm, and an exit track alarm.

12. A rail worker protection system comprising:

a first device having a display screen and configured to generate and send an identification code to a second device;

the second device having a display screen and configured to transmit a first request to the first device, to transmit a job site information to the first device and to transmit a remote device signal to a third device, wherein the job site information includes the identification code, a location coordinate and one or more confirmation signals; and the third device having an alarm component and an acknowledgement interface, the third device configured to issue an alarm with the alarm component, and to transmit a confirmation signal when a rail worker interacts with the acknowledgement interface.

* * * * *